US009740156B2

(12) United States Patent
Wada et al.

(10) Patent No.: US 9,740,156 B2
(45) Date of Patent: Aug. 22, 2017

(54) IMAGE FORMING APPARATUS THAT ADJUSTS A TRANSFER BIAS ACCORDING TO SURFACE PROPERTIES OF A TRANSFER TARGET

(71) Applicants: Yuuji Wada, Kanagawa (JP); Hiroyoshi Haga, Kanagawa (JP); Naohiro Kumagai, Kanagawa (JP); Seiichi Kogure, Kanagawa (JP); Junpei Fujita, Kanagawa (JP); Kazuki Yogosawa, Kanagawa (JP); Kenji Sugiura, Kanagawa (JP); Takehide Mizutani, Tokyo (JP); Tatsuya Ohsugi, Kanagawa (JP); Hirokazu Ishii, Tokyo (JP)

(72) Inventors: Yuuji Wada, Kanagawa (JP); Hiroyoshi Haga, Kanagawa (JP); Naohiro Kumagai, Kanagawa (JP); Seiichi Kogure, Kanagawa (JP); Junpei Fujita, Kanagawa (JP); Kazuki Yogosawa, Kanagawa (JP); Kenji Sugiura, Kanagawa (JP); Takehide Mizutani, Tokyo (JP); Tatsuya Ohsugi, Kanagawa (JP); Hirokazu Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/071,773

(22) Filed: Mar. 16, 2016

(65) Prior Publication Data

US 2016/0274504 A1 Sep. 22, 2016

(30) Foreign Application Priority Data

Mar. 19, 2015 (JP) ..... 2015-055964
Apr. 24, 2015 (JP) ..... 2015-089234
Jan. 22, 2016 (JP) ..... 2016-010350

(51) Int. Cl.
*G03G 15/16* (2006.01)
*G03G 15/00* (2006.01)

(52) U.S. Cl.
CPC ..... *G03G 15/6591* (2013.01); *G03G 15/1675* (2013.01); *G03G 15/1605* (2013.01); *G03G 2215/00776* (2013.01)

(58) Field of Classification Search
CPC ..... G03G 15/1665; G03G 15/1675; G03G 15/5029; G03G 15/1605; G03G 12/6591; G03G 2215/00776
(Continued)

(56) References Cited

U.S. PATENT DOCUMENTS 5,631,725 A 5/1997 Harasawa et al.
5,822,667 A 10/1998 Hayama et al.
(Continued)

FOREIGN PATENT DOCUMENTS

JP 2012-063746 3/2012
JP 2014-010383 1/2014
(Continued)

OTHER PUBLICATIONS

U.S. Appl. No. 14/822,180, filed Aug. 10, 2015.
(Continued)

*Primary Examiner* — Hoang Ngo
(74) *Attorney, Agent, or Firm* — Oblon, McClelland, Maier & Neustadt, L.L.P.

(57) ABSTRACT

An image forming apparatus includes a toner image forming unit, a nip formation member, a transfer power source, an information acquisition device, and a controller. The information acquisition device acquires specific information that specifies whether a recording sheet as a transfer target of a toner image is an uneven surface sheet having an uneven surface. The controller outputs a bias including a superim-
(Continued)

posed voltage, in which an alternating current (AC) voltage is superimposed on a direct current (DC) voltage, as a transfer bias from the transfer power source when the specific information acquired by the information acquisition device is not information corresponding to the uneven surface sheet and to output a bias including only the DC voltage as the transfer bias from the transfer power source when the specific information is the information corresponding to the uneven surface sheet.

18 Claims, 12 Drawing Sheets

(58) Field of Classification Search
USPC ..... 399/45, 66
See application file for complete search history.

(56) References Cited

U.S. PATENT DOCUMENTS

| | | | | |
|---|---|---|---|---|
| 6,282,386 | B1 | 8/2001 | Ishii | |
| 2003/0035658 | A1 | 2/2003 | Ishii | |
| 2007/0127941 | A1 | 6/2007 | Ishii et al. | |
| 2010/0008687 | A1 | 1/2010 | Ishii | |
| 2011/0229168 | A1* | 9/2011 | Shiraishi | G03G 15/1605 399/45 |
| 2012/0045259 | A1 | 2/2012 | Nakamura et al. | |
| 2012/0237271 | A1 | 9/2012 | Sengoku et al. | |
| 2012/0308250 | A1 | 12/2012 | Shimizu et al. | |
| 2012/0315058 | A1 | 12/2012 | Shimizu et al. | |
| 2012/0328321 | A1 | 12/2012 | Takeuchi et al. | |
| 2013/0004190 | A1 | 1/2013 | Sengoku et al. | |
| 2013/0011155 | A1 | 1/2013 | Ogiyama et al. | |
| 2013/0136468 | A1 | 5/2013 | Shimizu et al. | |
| 2013/0136477 | A1 | 5/2013 | Ogiyama et al. | |
| 2013/0164011 | A1 | 6/2013 | Nakamura et al. | |
| 2013/0236201 | A1 | 9/2013 | Mizutani et al. | |
| 2013/0308968 | A1 | 11/2013 | Tanaka et al. | |
| 2014/0029988 | A1 | 1/2014 | Shimizu et al. | |
| 2014/0079418 | A1 | 3/2014 | Tanaka et al. | |
| 2014/0241744 | A1* | 8/2014 | Ichikawa | G03G 15/1615 399/66 |
| 2014/0314435 | A1 | 10/2014 | Kato et al. | |
| 2014/0328603 | A1 | 11/2014 | Mizutani et al. | |
| 2014/0328604 | A1 | 11/2014 | Tanaka et al. | |
| 2015/0212454 | A1 | 7/2015 | Ichikawa et al. | |
| 2015/0378284 | A1 | 12/2015 | Wada et al. | |
| 2016/0033915 | A1 | 2/2016 | Kumagai et al. | |
| 2016/0041508 | A1 | 2/2016 | Kogure et al. | |

FOREIGN PATENT DOCUMENTS

| | | |
|---|---|---|
| JP | 2014-059433 | 4/2014 |
| JP | 2014-211476 | 11/2014 |
| JP | 2015-163933 | 9/2015 |

OTHER PUBLICATIONS

U.S. Appl. No. 14/881,611, filed Oct. 13, 2015.
U.S. Appl. No. 14/956,707, filed Dec. 2, 2015.
U.S. Appl. No. 14/966,398, filed Dec. 11, 2015.
U.S. Appl. No. 14/969,216, filed Dec. 15, 2015.
U.S. Appl. No. 14/962,062, filed Dec. 8, 2015.

* cited by examiner

IMAGE FORMING APPARATUS THAT ADJUSTS A TRANSFER BIAS ACCORDING TO SURFACE PROPERTIES OF A TRANSFER TARGET

CROSS-REFERENCE TO RELATED APPLICATIONS

This patent application is based on and claims priority pursuant to 35 U.S.C. §119(a) to Japanese Patent Application Nos. 2015-055964, filed on Mar. 19, 2015, 2015-089234, filed on Apr. 24, 2015, and 2016-010350, filed on Jan. 22, 2016, in the Japan Patent Office, the entire disclosure of which is hereby incorporated by reference herein.

BACKGROUND

Technical Field

Aspects of this disclosure relate to an image forming apparatus.

Related Art

An image forming apparatus is known to use a superimposed voltage, in which an alternating current voltage is superimposed voltage on a direct current voltage, as a transfer bias to flow a transfer current in a transfer nip, which is formed by the contact of a nip forming device and an image bearer to bear a toner image.

For example, an image forming apparatus secondarily transfers a toner image from an intermediate transfer belt onto a recording sheet in a secondary transfer nip, which is formed by the contact of the intermediate transfer belt as an image bearer and a nip formation roller as a nip forming device. In the secondary transfer, the image forming apparatus outputs, as the secondary transfer bias, a bias including a superimposed voltage in which an alternating current voltage is superimposed on a direct current voltage.

SUMMARY

In an aspect of this disclosure, there is provided an image forming apparatus that includes a toner image forming unit, a nip formation member, a transfer power source, an information acquisition device, and a controller. The toner image forming unit is configured to form a toner image on a surface of an image bearer. The nip formation member is configured to contact the surface of the image bearer to form a transfer nip. The transfer power source is configured to output a transfer bias to transfer the toner image from the image bearer onto a recording sheet in the transfer nip. The information acquisition device is configured to acquire specific information that specifies whether the recording sheet as a transfer target of the toner image is an uneven surface sheet having an uneven surface. The controller is configured to output a bias including a superimposed voltage, in which an alternating current (AC) voltage is superimposed on a direct current (DC) voltage, as the transfer bias from the transfer power source when the specific information acquired by the information acquisition device is not information corresponding to the uneven surface sheet and to output a bias including only the DC voltage as the transfer bias from the transfer power source when the specific information is the information corresponding to the uneven surface sheet.

In an aspect of this disclosure, there is provided an image forming apparatus that includes a toner image forming unit, a nip formation member, a transfer power source, an information acquisition device, and a controller. The toner image forming unit is configured to form a toner image on a surface of an image bearer. The nip formation member is configured to contact the surface of the image bearer to form a transfer nip. The transfer power source is configured to output a bias including a superimposed voltage, in which an alternating current (AC) voltage is superimposed on a direct current (DC) voltage, as a transfer bias to transfer the toner image from the image bearer onto a recording sheet in the transfer nip. The information acquisition device is configured to acquire specific information that specifies whether the recording sheet as a transfer target of the toner image is an uneven surface sheet having an uneven surface. The controller is configured to output a bias including a first superimposed voltage as the transfer bias from the transfer power source when the specific information acquired by the information acquisition device is not information corresponding to the uneven surface sheet and to output a bias including a second superimposed voltage, which has a peak-to-peak value smaller than a peak-to-peak value of the first superimposed voltage, as the transfer bias from the transfer power source when the specific information is the information corresponding to the uneven surface sheet.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

DETAILED DESCRIPTION

Figure 1:
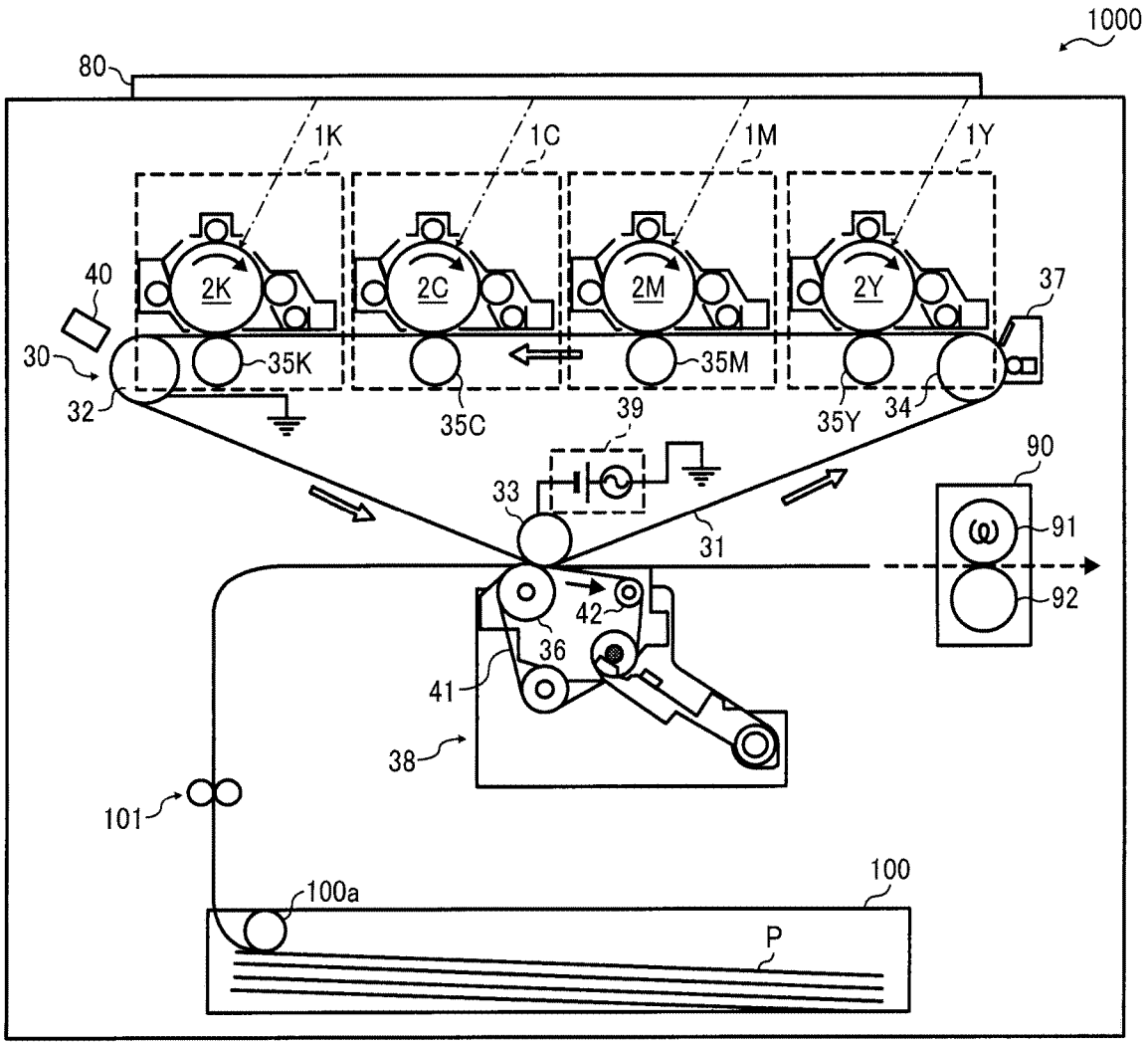
FIG. 1 is a schematic diagram of a printer as an example of an image forming apparatus according to a first embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

With reference to FIG. 1, a description is provided of an electrophotographic color printer as an example of an image forming apparatus according to a first embodiment of the present disclosure. Image forming apparatus according to embodiments of the present disclosure are not limited to printers and may be, for example, copiers, facsimile machines, and multifunction peripherals having functions of the copiers and facsimile machines.

First, a configuration of the image forming apparatus according to a first embodiment of the present disclosure is described below.

FIG. 1 is a schematic view of an image forming apparatus 1000 according to the first embodiment of the present disclosure. In FIG. 1, the image forming apparatus 1000 is illustrated as a printer. As illustrated in FIG. 1, the image forming apparatus 1000 according to the first embodiment includes four toner image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus 1000 also includes a transfer unit 30 serving as a transfer device, an optical writing unit 80, a fixing device 90, a sheet cassette 100, and a pair of registration rollers 101.

Figure 2:
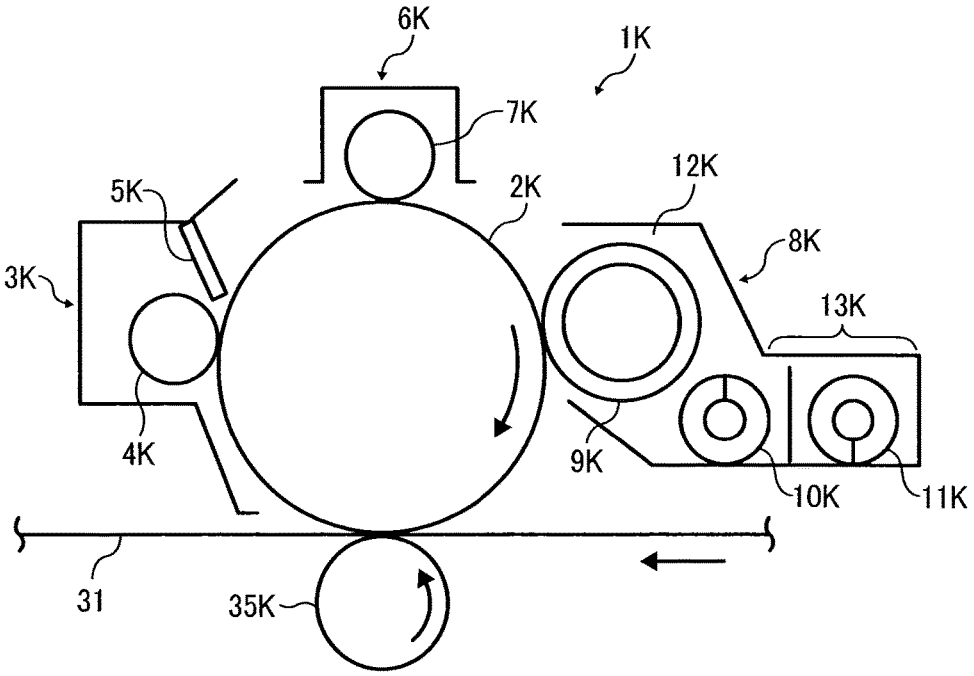
FIG. 2 is an enlarged view of a toner image forming unit for black color in the image forming apparatus of FIG. 1.

The toner image forming units 1Y, 1M, 1C, and 1K all have similar, if not the same, configuration except for different colors of toner employed. Thus, a description is provided of the toner image forming unit 1K for forming a toner image of black as a representative example of the toner image forming units 1Y, 1M, 1C, and 1K. The toner image forming units 1Y, 1M, 1C, and 1K are replaced upon reaching their product life cycles. With reference to FIG. 2, a description is provided of the toner image forming unit 1K as an example of the toner image forming units. FIG. 2 is a schematic diagram illustrating the toner image forming unit 1K. The toner image forming unit 1K includes a drum-shaped photoconductor 2K serving as a latent image bearer that bears a latent image. The photoconductor 2K is surrounded by various pieces of imaging equipment, such as a charging device 6K, a developing device 8K, a photoconductor cleaner 3K, and a charge remover. Such devices are held by a common holder so as to be attachable to and detachable from an apparatus body of the image forming apparatus 1000, thus allowing simultaneous replacement.

The photoconductor 2K includes a drum-shaped base on which an organic photosensitive layer is disposed. The photoconductor 2K is rotated in a clockwise direction by a driving device. The charging device 6K includes a charging roller 7K to which a charging bias is applied. The charging roller 7K contacts or is disposed in proximity to the photoconductor 2K to generate electrical discharge between the charging roller 7K and the photoconductor 2K, thereby charging uniformly the surface of the photoconductor 2K. According to the first embodiment, the photoconductor 2K is uniformly charged negatively, which is the same polarity as a normal charge polarity of toner. As a charging bias, an alternating current (AC) voltage superimposed on a direct current (DC) voltage is employed. The charging roller 7K includes a metal cored bar coated with a conductive elastic layer made of a conductive elastic material. According to the first embodiment, the photoconductor 2K is charged by the charging roller 7K contacting the photoconductor 2K or disposed near the photoconductor 2K. Alternatively, a corona charger may be employed.

The uniformly charged surface of the photoconductor 2K is scanned by laser light projected from the optical writing unit 80, thereby forming an electrostatic latent image for black on the surface of the photoconductor 2K. The electrostatic latent image for black on the photoconductor 2K is developed with black toner by the developing device 8K. Accordingly, a visible image, also known as a toner image of black, is formed on the photoconductor 8K. As described below, the toner image is transferred primarily onto an intermediate transfer belt 31 in a process known as a primary transfer process.

The photoconductor cleaner 3K removes residual toner remaining on the surface of the photoconductor 2K after the primary transfer process, that is, after the photoconductor 2K passes through a primary transfer nip. The photoconductor cleaner 3K includes a brush roller 4K and a cleaning blade 5K. The cleaning blade 5K is cantilevered, that is, one end of the cleaning blade 5K is secured to a housing of the photoconductor cleaner 3K, and its free end contacts the surface of the photoconductor 2K. The brush roller 4K rotates and brushes off the residual toner from the surface of the photoconductor 2K while the cleaning blade 5K removes the residual toner by scraping.

The charge remover removes residual charge remaining on the photoconductor 2K after the surface thereof is cleaned by the photoconductor cleaner 3K. The surface of the photoconductor 2K is initialized in preparation for the subsequent imaging cycle.

The developing device 8K serving as a developer bearer includes a developing portion 12K and a developer conveyor 13K. The developing portion 12K includes a developing roller 9K inside thereof. The developer convener 13K mixes a black developing agent and transports the black developing agent. The developer convener 13K includes a first chamber equipped with a first screw 10K and a second chamber equipped with a second screw 11K. The first screw 10K and the second screw 11K are each constituted of a rotatable shaft and helical blade wrapped around the circumferential surface of the shaft. Each end of the shaft of the first screw 10 and the second screw 11K in the axial direction of the shaft is rotatably held by shaft bearings.

The first chamber with the first screw 10K and the second chamber with the second screw 11K are separated by a wall, but each end of the wall in the axial direction of the screw shaft has a connecting hole through which the first chamber and the second chamber communicate with each other. The first screw 10K mixes the developing agent by rotating the helical flighting and carries the developing agent from the distal end to the proximal end of the screw in the direction perpendicular to the drawing plane while rotating. The first screw 10K is disposed parallel to and facing the developing roller 9K. The black developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K passes through the connecting hole in the wall near the proximal side and enters the second chamber. Subsequently, the developing agent is carried by the helical flighting of the second screw 11K. As the second screw 11K rotates, the developing agent is delivered from the proximal end to the distal end in FIG. 2 while being mixed in the direction of rotation.

In the second chamber, a toner density sensor for detecting the density of black toner in black developing agent is disposed at the bottom of a casing of the chamber. As the toner density sensor for black toner, a magnetic permeability detector is employed. There is a correlation between the density of black toner and the magnetic permeability of the black developing agent including toner particles and magnetic carrier particles. Therefore, the magnetic permeability detector can detect the density of black toner.

The image forming apparatus 1000 includes Y, M, C, and K toner supply devices to supply independently yellow, magenta, cyan, and black toners to the respective second chambers of the developing devices 8Y, 8M, 8C, and 8K. The controller of the image forming apparatus 1000 includes a Random Access Memory (RAM) to store target output voltages Vtref for output voltages provided by the toner density sensors for yellow, magenta, cyan, and black. If the difference between the output voltages provided by the toner density sensors for yellow, magenta, cyan, and black, and Vtref for each color exceeds a predetermined value, the toner supply devices are driven for a predetermined time period corresponding to the difference to supply toner. Accordingly, the Y, M, C, and K color toners are supplied to the respective second chambers of the developing devices 8Y, 8M, 8C, and 8K, and thus the density of black toner in the black developer agent is maintained within a predetermined range.

The developing roller 9K in the developing portion 12K faces the first screw 10K as well as the photoconductor 2K through an opening formed in the casing of the developing device 8K. The developing roller 9K includes a cylindrical developing sleeve made of a non-magnetic pipe which is rotated, and a magnetic roller disposed inside the developing sleeve. The magnetic roller is fixed so as not to rotate together with the developing sleeve. The black developing agent supplied from the first screw 10K is carried on the surface of the developing sleeve due to the magnetic force of the magnetic roller. As the developing sleeve rotates, the developing agent is transported to a developing area facing the photoconductor 2K.

The developing sleeve is supplied with a developing bias having the same polarity as the polarity of toner. An absolute value of the developing bias is greater than the potential of the electrostatic latent image on the photoconductor 2K, but less than the charge potential of the uniformly charged photoconductor 2K. With this configuration, a developing potential that causes the toner on the developing sleeve to move electrostatically to the electrostatic latent image on the photoconductor 2K acts between the developing sleeve and the electrostatic latent image on the photoconductor 2K. A background potential acts between the developing sleeve and a background area of the photoconductor 2K, causing the toner on the developing sleeve to move to the sleeve surface. Due to the developing potential and the background potential, the toner on the developing sleeve moves selectively to the electrostatic latent image formed on the photoconductor 2K, thereby forming a visible image, known as a toner image.

Similar to the toner image forming unit 1K, toner images of yellow, magenta, and cyan are formed on the photoconductors 2Y, 2M, and 2C of the toner image forming units 1Y, 1M, and 1C, respectively. The optical writing unit 80 for writing latent images on the photoconductors 2 is disposed above the toner image forming units 1Y, 1M, 1C, and 1K. Based on image information provided by an external device such as a personal computer (PC), the optical writing unit 80 illuminates the photoconductors 2Y, 2M, 2C, and 2K with the laser light projected from a laser diode of the optical writing unit 80. Accordingly, the electrostatic latent images of yellow, magenta, cyan, and black are formed on the photoconductors 2Y, 2M, 2C, and 2K, respectively. The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photoconductor 2Y. Alternatively, the optical writing unit 80 may employ a light source using an LED array including a plurality of LEDs that projects light.

Referring back to FIG. 1, a description is provided of the transfer unit 30. The transfer unit 30 is disposed below the toner image forming units 1Y, 1M, 1C, and 1K. The transfer unit 30 includes the intermediate transfer belt 31 serving as an image bearing member formed into an endless loop and rotated in the counterclockwise direction. The transfer unit 30 also includes a plurality of rollers: a drive roller 32, a secondary-transfer first roller 33, a cleaning auxiliary roller 34, and four primary transfer rollers 35Y, 35M, 35C, and 35K (which may be referred to collectively as primary transfer rollers 35). The primary transfer rollers 35Y, 35M, 35C, and 35K are disposed opposite to the photoconductors 2Y, 2M, 2C, and 2K, respectively, via the intermediate transfer belt 31.

The secondary-transfer first roller 33 is disposed inside the looped intermediate transfer belt 31 and contacts the back surface of the intermediate transfer belt 31 which is an opposite surface to the front surface. The transfer unit 30 also includes a belt cleaning device 37 and a density sensor 40. The intermediate transfer belt 31 is entrained around and stretched taut between the plurality of rollers, i.e., the drive roller 32, the secondary-transfer first roller 33, the cleaning auxiliary roller 34, and the four primary transfer rollers 35Y, 35M, 35C, and 35K. The drive roller 32 is rotated in the counterclockwise direction by a motor or the like, and rotation of the driving roller 32 enables the intermediate transfer belt 31 to rotate in the same direction.

The intermediate transfer belt 31 is interposed between the photoconductors 2Y, 2M, 2C, and 2K, and the primary transfer rollers 35Y, 35M, 35C, and 35K. Accordingly, primary transfer nips are formed between the outer peripheral surface or the image bearing surface of the intermediate transfer belt 31 and the photoconductors 2Y, 2M, 2C, and 2K that contact the intermediate transfer belt 31. A primary transfer power source applies a primary transfer bias to the primary transfer rollers 35Y, 35M, 35C, and 35K. Accordingly, a transfer electric field is formed between the primary transfer rollers 35Y, 35M, 35C, and 35K, and the toner images of yellow, magenta, cyan, and black formed on the photoconductors 2Y, 2M, 2C, and 2K. The yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electrical field and the nip pressure. The intermediate transfer belt 31, on which the yellow toner image has been transferred, passes through the primary transfer nips of magenta, cyan, and black. Subsequently, the toner images on the photoconductors 2M, 2C, and 2K are superimposed on the yellow toner image which has been transferred on the intermediate transfer belt 31, one atop the other, thereby forming a composite toner image on the intermediate transfer belt 31 in the primary transfer process. Accordingly, the composite toner image, in which the toner images of yellow, magenta, cyan, and black are superimposed one atop the other, is formed on the surface of the intermediate transfer belt 31. According to this embodiment, a roller-type transfer device (here, the primary transfer rollers 35) is used as a primary transfer device. Alternatively, a transfer charger or a transfer brush may be employed as a primary transfer device.

A sheet conveyor unit 38, disposed substantially below the transfer unit 30, includes a secondary-transfer second roller 36 disposed opposite to the secondary-transfer first roller 33 via the intermediate transfer belt 31 and a sheet conveyor belt 41 (generally referred to as a secondary transfer belt or a secondary transfer member). As illustrated in FIG. 1, the sheet conveyor belt 41 is formed into an endless loop and looped around a plurality of rollers including the secondary-transfer second roller 36. As the secondary-transfer second roller 36 is driven to rotate, the sheet conveyor belt 41 is rotated in the clockwise direction in FIG. 1. The secondary-transfer second roller 36 contacts, via the sheet conveyor belt 41, a portion of the front surface or the image bearing surface of the intermediate transfer belt 31 looped around the secondary-transfer first roller 33. That is, the intermediate transfer belt 31 and the sheet conveyor belt 41 are interposed between the secondary-transfer first roller 33 of the transfer unit 30 and the secondary-transfer second roller 36 of the sheet conveyor unit 38. Accordingly, the outer peripheral surface or the image bearing surface of the intermediate transfer belt 31 contacts the outer peripheral surface of the sheet conveyor belt 41 serving as the nip forming member, thereby forming a secondary transfer nip. The secondary-transfer second roller 36 disposed inside the loop of the sheet conveyor belt 41 is grounded; whereas, a secondary transfer bias is applied to the secondary-transfer first roller 33 disposed inside loop of the intermediate transfer belt 31 by a secondary transfer power source 39. With this configuration, a secondary transfer electrical field is formed between the secondary-transfer first roller 33 and the secondary-transfer second roller 36 so that the toner having a negative polarity is transferred electrostatically from the secondary-transfer first roller side to the secondary-transfer second roller side. Alternatively, instead of the sheet conveyor belt 41, a secondary transfer roller may be employed as the nip forming device to contact directly the intermediate transfer belt 31.

As illustrated in FIG. 1, the sheet cassette 100 storing a sheaf of recording sheets P is disposed below the transfer unit 31. The sheet cassette 100 is equipped with a feed roller 100*a* that contacts the top sheet of the sheaf of recording sheets P. As the feed roller 100*a* is rotated at a predetermined speed, the sheet feed roller 100*a* picks up and sends the top sheet of the recording sheets P to a sheet delivery path. Substantially near the end of the sheet delivery path, the pair of registration rollers 101 is disposed. The pair of registration rollers 101 stops rotating temporarily as soon as the recording sheet P fed from the sheet cassette 100 is interposed between the pair of registration rollers 101. The pair of registration rollers 101 starts to rotate again to feed the recording sheet P to the secondary transfer nip in appropriate timing such that the recording sheet P is aligned with the composite toner image formed on the intermediate transfer belt 31 at the secondary transfer nip. In the secondary transfer nip, the recording sheet P tightly contacts the composite toner image on the intermediate transfer belt 31, and the composite toner image is secondarily transferred onto the recording sheet P by the secondary transfer electric field and the nip pressure applied thereto, thereby forming a full-color toner image on the recording sheet P. The recording sheet P, on which the full-color toner image is formed, passes through the secondary transfer nip and separates from the intermediate transfer belt 31 due to self-stripping. Furthermore, the curvature of a separation roller 42, around which the sheet conveyor belt 41 is looped, enables the recording sheet P to separate from the sheet conveyor belt 41.

According to the present illustrative embodiment, the sheet conveyor belt 41 as the nip forming device contacts the intermediate transfer belt 31 to form the secondary transfer nip. Alternatively, a nip forming roller as the nip forming device may contact the intermediate transfer belt 31 to form the secondary transfer nip.

After the intermediate transfer belt 31 passes through the secondary transfer nip N, residual toner not having been transferred onto the recording sheet P remains on the intermediate transfer belt 31. The residual toner is removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports the cleaning operation performed by the belt cleaning device 37.

As illustrated in FIG. 1, the density sensor 40 is disposed outside the loop formed by the intermediate transfer belt 31.

More specifically, the density sensor 40 faces a portion of the intermediate transfer belt 31 looped around the drive roller 32 with a predetermined gap between the density sensor 40 and the intermediate transfer belt 31. An amount of toner adhered to the toner image per unit area (image density) primarily transferred onto the intermediate transfer belt 31 is measured when the toner image comes to the position opposite to the density sensor 40.

The fixing device 90 is disposed downstream from the secondary transfer nip in the direction of conveyance of the recording sheet P. The fixing device 90 includes a fixing roller 91 and a pressing roller 92. The fixing roller 91 includes a heat source such as a halogen lamp inside the fixing roller 91. While rotating, the pressing roller 92 pressingly contacts the fixing roller 91, thereby forming a heated area called a fixing nip therebetween. The recording sheet P bearing an unfixed toner image on the surface thereof is delivered to the fixing device 90 and interposed between the fixing roller 91 and the pressing roller 92 in the fixing device 90. Under heat and pressure, the toner adhered to the toner image is softened and fixed to the recording sheet P in the fixing nip. Subsequently, the recording sheet P is output outside the image forming apparatus 1000 from the fixing device 90 via a post-fixing delivery path after the fixing process.

According to the first embodiment, for forming a monochrome image, an orientation of a support plate supporting the primary transfer rollers 35Y, 35M, and 35C of the transfer unit 30 is changed by driving a solenoid or the like. With this configuration, the primary transfer rollers 35Y, 35M, and 35C are separated from the photoconductors 2Y, 2M, and 2C, thereby separating the outer peripheral surface or the image bearing surface of the intermediate transfer belt 31 from the photoconductors 2Y, 2M, and 2C. In a state in which the intermediate transfer belt 31 contacts only the photoconductor 2K, only the toner image forming unit 1K for black among four toner image forming units is driven to form a black toner image on the photoconductor 2K. It is to be noted that an image forming apparatus according to an embodiment of the present disclosure is not limited to an image forming apparatus for forming a color image but may be a monochrome image forming apparatus for forming a single-color image.

Figure 3:
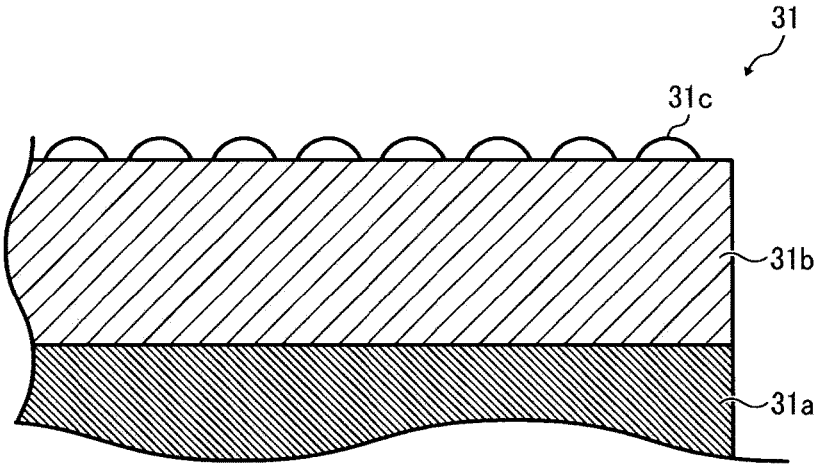
FIG. 3 is a partially enlarged cross-sectional view of an intermediate transfer belt in the image forming apparatus of FIG. 1.
Figure 4:
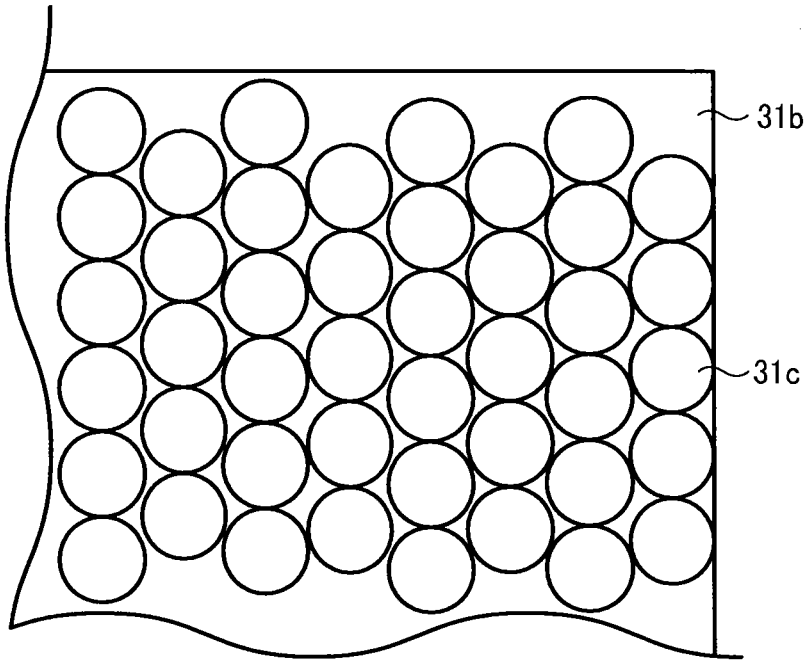
FIG. 4 is a partially enlarged plan view of the intermediate transfer belt.

FIG. 3 is a partially enlarged cross-sectional view schematically illustrating a transverse plane of the intermediate transfer belt 31. As illustrated in FIG. 3, the intermediate transfer belt 31 includes a base layer 31*a* and an elastic layer 31*b*. The base layer 31*a* formed into an endless looped belt is formed of a material having a high stiffness, but having some flexibility. The elastic layer 31*b* disposed on the front surface of the base layer 31*a* is formed of an elastic material with high elasticity. Particles 31*c* are dispersed in the elastic layer 31*b*. While a portion of the particles 31*c* projects from the elastic layer 31*b*, the particles 31*c* are arranged concentratedly in a belt surface direction as illustrated in FIG. 4. With these particles 31*c*, a rough surface of the belt with multiple bumps is formed on the intermediate transfer belt 31.

Examples of materials for the base layer 31*a* include, but are not limited to, a resin in which an electrical resistance adjusting material made of a filler or an additive is dispersed to adjust electrical resistance. Examples of the resin constituting the base layer 31*a* include, but are not limited to, fluorine-based resins such as ethylene tetrafluoroethylene copolymers (ETFE) and polyvinylidene fluoride (PVDF) in terms of flame retardancy, and polyimide resins or polyamide-imide resins. In terms of mechanical strength (high elasticity) and heat resistance, specifically, polyimide resins or polyamide-imide resins are more preferable.

Examples of the electrical resistance adjusting materials dispersed in the resin include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include, but are not limited to, ketchen black, furnace black, acetylene black, thermal black, and gas black. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Two or more ion conductive materials can be mixed. It is to be noted that electrical resistance adjusting materials are not limited to the above-mentioned materials.

A dispersion auxiliary agent, a reinforcing material, a lubricating material, a heat conduction material, an antioxidant, and so forth may be added to a coating liquid which is a precursor for the base layer 31*a*, as needed. The coating solution is a liquid resin before curing in which electrical resistance adjusting materials are dispersed. An amount of the electrical resistance adjusting materials to be dispersed in the base layer 31*a* of a seamless belt, i.e., the intermediate transfer belt 31 is preferably in a range from $1\times10^{8}$ to $1\times10^{13}$ Ω/sq in surface resistivity, and in a range from $1\times10^{6}$ to $10^{12}$ Ω·cm in volume resistivity. In terms of mechanical strength, an amount of the electrical resistance adjusting material to be added is determined such that the formed film is not fragile and does not crack easily. Preferably, a coating liquid, in which a mixture of the resin component (for example, a polyimide resin precursor and a polyamide-imide resin precursor) and the electrical resistance adjusting material are adjusted properly, is used to manufacture a seamless belt (i.e., the intermediate transfer belt 31) in which the electrical characteristics (i.e., the surface resistivity and the volume resistivity) and the mechanical strength are well balanced. The content of the electrical resistance adjusting material in the coating liquid when using carbon black is in a range from 10% to 25% by weight or preferably, from 15% to 20% by weight relative to the solid content. The content of the electrical resistance adjusting material in the coating liquid when using metal oxides is in a range from 1% to 50% by weight or more preferably, in a range from 10% to 30% by weight relative to the solid content. If the content of the electrical resistance adjusting material is less than the above-described respective range, a desired effect is not achieved. If the content of the electrical resistance adjusting material is greater than the above-described respective range, the mechanical strength of the intermediate transfer belt (seamless belt) 31 drops, which is undesirable in actual use.

The thickness of the base layer 31*a* is not limited to a particular thickness and can be selected as needed. The thickness of the base layer 31*a* is preferably in a range from 30 μm to 150 μm, more preferably in a range from 40 μm to 120 μm, even more preferably, in a range from 50 μm to 80 μm. The base layer 31*a* having a thickness of less than 30 μm cracks and gets torn easily. The base layer 31*a* having a thickness of greater than 150 μm cracks when it is bent. By contrast, if the thickness of the base layer 31*a* is in the above-described respective range, the durability is enhanced.

In order to increase the stability of traveling of the intermediate transfer belt 31, preferably, the thickness of the base layer 31*a* is uniform as much as possible. An adjustment method to adjust the thickness of the base layer 31*a* is not limited to a particular method, and can be selected as needed. For example, the thickness of the base layer 31*a* can be measured using a contact-type or an eddy-current thickness meter or a scanning electron microscope (SEM) which measures a cross-section of the film.

As described above, the elastic layer 31*b* of the intermediate transfer belt 31 has a surface with a plurality of projections formed of the particles 31*c* dispersed in the elastic layer 31*b*. Examples of elastic materials for the elastic layer 31*b* include, but are not limited to, generally-used resins, elastomers, and rubbers. Preferably, elastic materials having good elasticity such as elastomer materials and rubber materials are used. Examples of the elastomer materials include, but are not limited to, polyesters, polyamides, polyethers, polyurethanes, polyolefins, polystyrenes, polyacrylics, polydiens, silicone-modified polycarbonates, and thermoplastic elastomers such as fluorine-containing copolymers. Examples of thermosetting resins include, but are not limited to, polyurethane resins, silicone-modified epoxy resins, and silicone modified acrylic resins. Examples of rubber materials include, but are not limited to isoprene rubbers, styrene rubbers, butadiene rubbers, nitrile rubbers, ethylene-propylene rubbers, butyl rubbers, silicone rubbers, chloroprene rubbers, acrylic rubbers, chlorosulfonated polyethylenes, fluorocarbon rubbers, urethane rubbers, and hydrin rubbers. A material having desired characteristics can be selected from the above-described materials. In particular, in order to fit a recording sheet with an uneven surface, such as Leathac (registered trademark), soft materials are preferable. Note that the term "uneven" used herein also includes meanings of not only rough but, for example, irregular, textured, embossed, and rough. Because the particles 31*c* are dispersed, thermosetting materials are more preferable than thermoplastic materials. The thermosetting materials have a good adhesion property relative to resin particles due to an effect of a functional group contributing to the curing reaction, thereby fixating reliably. For the same reason, vulcanized rubbers are also preferable.

In terms of ozone resistance, softness, adhesion properties relative to the particles, application of flame retardancy, environmental stability, and so forth, acrylic rubbers are most preferable among elastic materials for forming the elastic layer 31*b*. Acrylic rubbers are not limited to a specific product. Commercially-available acrylic rubbers can be used. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and good workability. Preferably, amine compounds are used as crosslinking agents for the acrylic rubber of the carboxyl group crosslinking type. More preferably, multivalent amine compounds are used. Examples of the amine compounds include, but are not limited to, aliphatic multivalent amine crosslinking agents and aromatic multivalent amine crosslinking agents. Furthermore, examples of the aliphatic multivalent amine crosslinking agents include, but are not limited to, hexamethylenediamine, hexamethylenediamine carbamate, and N,N'-dicinnamylidene-1,6-hexanediamine. Examples of the aromatic multivalent amine crosslinking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene) dianiline, 4,4'-(p-phenylenediisopropylidene) dianiline, 2,2'-bis [4-(4-aminophenoxy)phenyl] propane, 4,4'-diaminobenzanilide, 4,4'-bis (4-aminophenoxy)biphenyl, m-xylylenediamine, p-xylylenediamine, 1,3,5-benzenetriamine, and 1,3,5-benzenetriaminomethyl.

The amount of the crosslinking agent is, preferably, in a range from 0.05 to 20 parts by weight, more preferably, from 0.1 to 5 parts by weight, relative to 100 parts by weight of the acrylic rubber. An insufficient amount of the crosslinking agent causes failure in crosslinking, hence complicating efforts to maintain the shape of crosslinked products. By contrast, too much crosslinking agent causes crosslinked products to be too stiff, hence degrading elasticity as a crosslinking rubber.

In order to enhance a cross-linking reaction, a crosslinking promoter may be mixed in the acrylic rubber employed for the elastic layer 31*b*. The type of crosslinking promoter is not limited particularly. However, it is preferable that the crosslinking promoter can be used with the above-described multivalent amine crosslinking agents. Such crosslinking promoters include, but are not limited to, guanidino compounds, imidazole compounds, quaternary onium salts, tertiary phosphine compounds, and weak acid alkali metal salts. Examples of the guanidino compounds include, but are not limited to, 1, 3, 1,3-diphenylguanidine, and 1,3-di-o-tolylguanidine. Examples of the imidazole compounds include, but are not limited to, 2-methylimidazole and 2-phenylimidazole. Examples of the quaternary onium salts include, but are not limited to, tetra-n-butylammonium bromide and octadecyltri-n-butylammonium bromide. Examples of the multivalent tertiary amine compounds include, but are not limited to, triethylenediamine and 1,8-diazabicyclo[5.4.0]undec-7-ene (DBU). Examples of the tertiary phosphines include, but are not limited to, triphenylphosphine and tri(p-tolyl)phosphine. Examples of the weak acid alkali metal salts include, but are not limited to, phosphates such as sodium and potassium, inorganic weak acid salts such as carbonate or stearic acid salt, and organic weak acid salts such as lauric acid salt.

The amount of the crosslinking promoter is, preferably, in a range from 0.1 to 20 parts by weight, more preferably, from 0.3 to 10 parts by weight, relative to 100 parts by weight of the acrylic rubber. Too much crosslinking promoter causes undesirable acceleration of crosslinking during crosslinking, generation of bloom of the crosslinking promoter on the surface of crosslinked products, and hardening of the crosslinked products. By contrast, an insufficient amount of the crosslinking agent causes degradation of the tensile strength of the crosslinked products and a significant elongation change or a significant change in the tensile strength after heat load.

The acrylic rubber composition of the present disclosure can be prepared by an appropriate mixing procedure such as roll mixing, Banbury mixing, screw mixing, and solution mixing. The order in which the ingredients are mixed is not particularly limited. However, it is preferable that ingredients that are not easily reacted or decomposed when heated are first mixed thoroughly, and thereafter, ingredients that are easily reacted or decomposed when heated, such as a crosslinking agent, are mixed together in a short period of time at a temperature at which the crosslinking agent is neither reacted not decomposed.

When heated, the acrylic rubber serves as a crosslinked product. The heating temperature is preferably in a range of 130° C. to 220° C., more preferably, 140° C. to 200° C. The crosslinking time period is preferably in a range of 30 seconds to 5 hours. The heating methods can be chosen from those which are conventionally used for crosslinking rubber compositions, such as press heating, steam heating, oven heating, and hot-air heating. In order to reliably crosslink the inside of the crosslinked product, post crosslinking may be additionally carried out after crosslinking is carried out once. The post crosslinking time period varies depending on the heating method, the crosslinking temperature and the shape of crosslinked product, but is carried out preferably for 1 to 48 hours. The heating method and the heating temperature may be appropriately chosen. Electrical resistance adjusting agents for adjustment of electrical characteristics and flame retardants to achieve flame retardancy may be added to the selected materials. Furthermore, antioxidants, reinforcing agents, fillers, and crosslinking promoters may be added as needed. The electrical resistance adjusting agents to adjust electrical resistance can be selected from the above-described materials. However, since the carbon blacks and the metal oxides impair flexibility, it is preferable to minimize the amount of use. Ion conductive materials and conductive high polymers are also effective. Alternatively, these materials can be used in combination.

Preferably, various types of perchlorates and ionic liquids in an amount from about 0.01 parts by weight to 3 parts by weight are added, based on 100 parts by weight of rubber. With the ion conductive material in an amount 0.01 parts by weight or less, the resistivity cannot be reduced effectively. However, with the ion conductive material in an amount 3 parts by weight or more, it is highly possible that the conductive material blooms or bleeds to the belt surface.

The electrical resistance adjusting material to be added is in such an amount that the surface resistivity of the elastic layer 31*b* is, preferably, in a range from $1\times10^{8}$ Ω/sq to $1\times10^{13}$ Ω/sq, and the volume resistivity of the elastic layer 31*b* is, preferably, in a range from $1\times10^{6}$ Ω·cm to $1\times10^{12}$ Ω·cm. In order to obtain high toner transferability relative to an uneven surface of a recording sheet as is desired in image forming apparatuses using electrophotography in recent years, it is preferable to adjust a micro rubber hardness of the elastic layer 31*b* to 35 or less under the condition 23° C., 50% RH. In measurement of Martens hardness and Vickers hardness, which are a so-called micro-hardness, a shallow area of a measurement target in a bulk direction, that is, the hardness of only a limited area near the surface is measured. Thus, deformation capability of the entire belt cannot be evaluated. Consequently, for example, in a case in which a soft material is used for the uppermost layer of the intermediate transfer belt 31 with a relatively low deformation capability as a whole, the micro-hardness decreases. In such a configuration, the intermediate transfer belt 31 with a low deformation capability does not conform to the surface condition of the uneven surface of the recording sheet, thereby impairing the desired transferability relative to the uneven surface of the recording sheet. In view of the above, preferably, the micro-rubber hardness, which allows the evaluation of the deformation capability of the entire intermediate transfer belt 31, is measured to evaluate the hardness of the intermediate transfer belt 31.

The layer thickness of the elastic layer 31*b* is, preferably, in a range from 200 μm to 2 mm, more preferably, 400 μm to 1000 μm. The layer thickness less than 200 μm hinders deformation of the belt in accordance with the uneven surface (surface condition) of the recording sheet and a transfer-pressure reduction effect. By contrast, the layer thickness greater than 2 mm causes the elastic layer 31*b* to sag easily due to its own weight, resulting in unstable movement of the intermediate transfer belt 31 and damage to the intermediate transfer belt 31 looped around rollers. The layer thickness can be measured by observing the cross-section of the elastic layer 31*b* using a scanning electron microscope (SEM), for example.

The particle 31*c* to be dispersed in the elastic material of the elastic layer 31*b* is a spherical resin particle having an average particle diameter of equal to or less than 100 μm and are insoluble in an organic solvent. Furthermore, the 3% thermal decomposition temperature of these resin particles is equal to or greater than 200° C. The resin material of the particle 31*c* is not particularly limited, but may include acrylic resins, melamine resins, polyamide resins, polyester resins, silicone resins, fluorocarbon resins, and rubbers. Alternatively, in some embodiments, surface processing with different material is applied to the surface of the particle made of resin materials. A surface of a spherical mother particle made of rubber may be coated with a hard resin. Furthermore, the mother particle may be hollow or porous.

Among such resins mentioned above, the silicone resin particles are most preferred because the silicone resin particles provide good slidability, releasability relative to toner, and wear and abrasion resistance. Preferably, the spherical resin particles are prepared through a polymerization process. The more spherical the particle is, the more preferred. Preferably, the volume average particle diameter of the particle is in a range from 1.0 μm to 5.0 μm, and the particle dispersion is monodisperse with a sharp distribution. The monodisperse particle is not a particle with a single particle diameter. The monodisperse particle is a particle having a sharp particle size distribution. More specifically, the distribution width of the particle is equal to or less than ±(Average particle diameter×0.5 μm). With the particle diameter of the particle 31*c* less than 1.0 μm, enhancement of transfer performance by the particle 31*c* cannot be achieved sufficiently. By contrast, with the particle diameter greater than 5.0 μm, the space between the particles increases, which results in an increase in the surface roughness of the intermediate transfer belt 31. In this configuration, toner is not transferred well, and the intermediate transfer belt 31 cannot be cleaned well. In general, the particle 31*c* made of resin material has a relatively high insulation property. Thus, if the particle diameter is too large, accumulation of electrical charges of the particle diameter 31*c* during continuous printing causes image defect easily.

Either commercially-available products or laboratory-derived products may be used as the particle 31*c*. The thus-obtained particle 31*c* is directly applied to the elastic layer 31*b* and evened out, thereby evenly distributing the particle 31*c* with ease. With this configuration, an overlap of the particles 31*c* in the belt thickness direction is reduced, if not prevented entirely. Preferably, the cross-sectional diameter of the plurality of particles 31*c* in the surface direction of the elastic layer 31*b* is as uniform as possible. More specifically, the distribution width thereof is equal to or less than ±(Average particle diameter×0.5 μm). For this reason, preferably, powder including particles with a small particle diameter distribution is used as the particles 31*c*. If the particles 31*c* having a specific particle diameter can be applied to the elastic layer 31*b* selectively, it is possible to use particles having a relatively large particle diameter distribution. It is to be noted that timing at which the particles 31*c* are applied to the surface of the elastic layer 31*b* is not particularly limited. The particles 31*c* can be applied before or after crosslinking of the elastic material of the elastic layer 31*b*.

Preferably, a projected area ratio of a portion of the elastic layer 31*b* having the particles 31*c* relative to the elastic layer 31*b* with its surface being exposed is equal to or greater than 60% in the surface direction of the elastic layer 31*b*. In a case in which the projected area ratio is less than 60%, the frequency of direct contact between toner and the pure surface of the elastic layer 31*b* increases, thereby degrading transferability of toner, cleanability of the belt surface from which toner is removed, and filming resistance. In some embodiments, a belt without the particles 31*c* dispersed in the elastic layer 31*b* can be used as the intermediate transfer belt 31.

As illustrated in FIG. 4, little overlap between the particles 31*c* is observed on the surface of the intermediate transfer belt 31. Preferably, the cross-sectional diameter of the particles 31*c* on the surface of the elastic layer 31*b* is as uniform as possible. More specifically, the distribution width thereof is equal to or less than ±(average particle diameter× 0.5 μm). To achieve the distribution width, it is preferable to use particle powder having a narrow particle-diameter distribution. However, if a method of selectively localizing particles 31*c* having a specified particle diameter on the surface to form the elastic layer 31*b*, particle powder having a wide particle-diameter distribution may be used.

When using an uneven surface sheet such as Japanese paper (washi) as the recording sheet P, preferably the elastic layer 31*b* has good flexibility (elasticiy) to some extent to secondarily transfer toner onto a plurality of recessed portions in the surface of the recording sheet P in a favorable manner and reduce the occurrence of uneven image density due to the uneven surface. However, when the elastic layer 31*b* having such good flexibility is stretched, the elastic layer 31*b* itself is likely to lose flexibility, which is disadvantageous in actual use. Accordingly, the base layer 31*a* having a higher stiffness than the elastic layer 31*b* is disposed so that the stiffness of the base layer 31*a* prevents the entire intermediate transfer belt 31 from losing flexibility.

Figure 5:
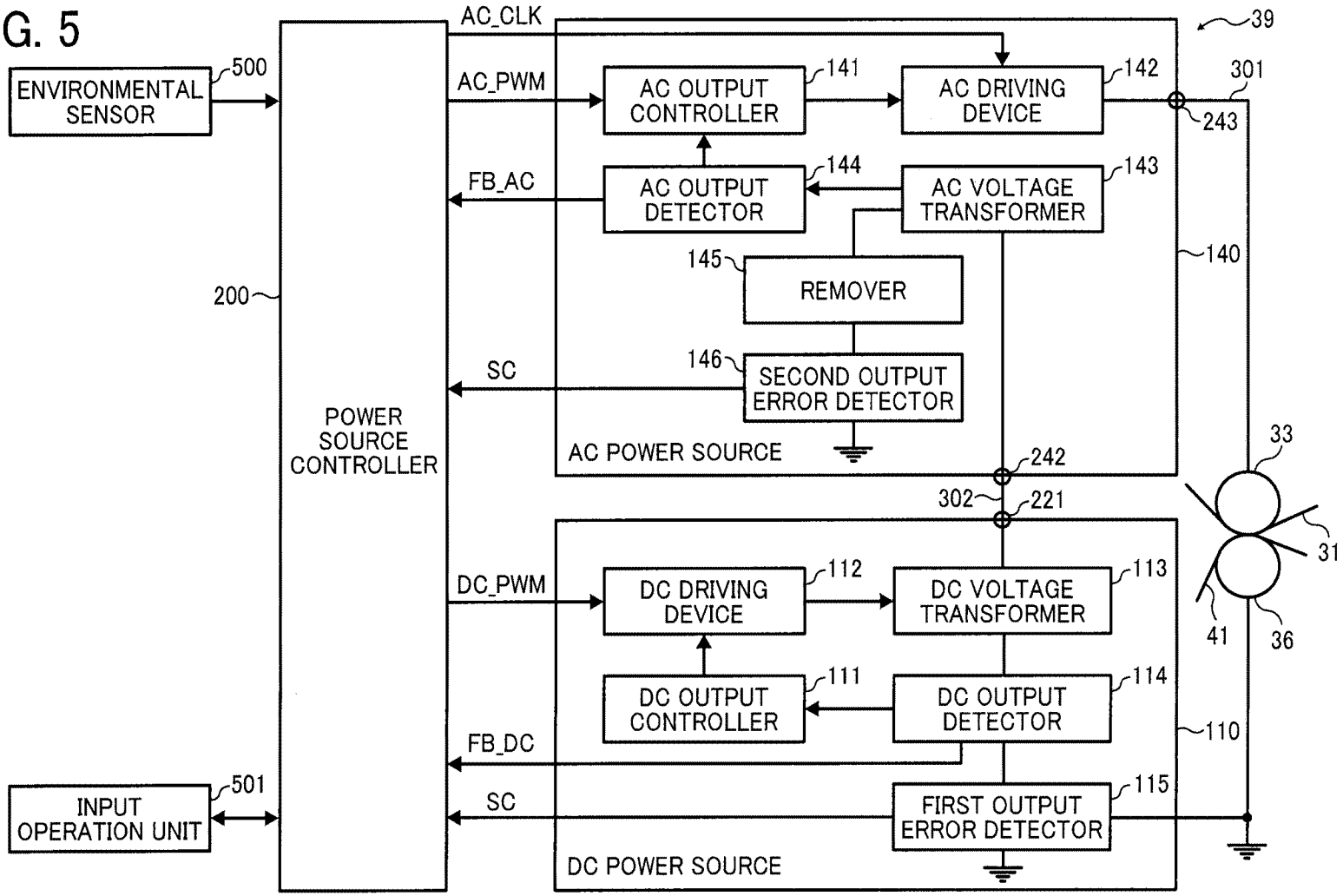
FIG. 5 is a block diagram of a portion of an electrical circuit of a secondary transfer power source, a secondary-transfer first roller, and a secondary-transfer second roller in the image forming apparatus of FIG. 1.

FIG. 5 is a block diagram illustrating a portion of an electrical circuit of a secondary transfer power source, the secondary-transfer first roller 33, and the secondary-transfer second roller 36 employed in the image forming apparatus 1000 of FIG. 1 according to the first embodiment of the present disclosure. As illustrated in FIG. 5, the secondary transfer power source 39 includes a direct-current (DC) power source 110 and an alternating current (AC) power source 140, a power source controller 200, and so forth. The AC power source 140 is detachably mountable relative to a maim body of the secondary transfer power source 39. The DC power source 110 outputs a DC voltage to apply an electrostatic force to toner on the intermediate transfer belt 31 so that the toner moves from the belt side to the recording sheet side in the secondary transfer nip. The DC power source 110 includes a DC output controller 111, a DC driving device 112, a DC voltage transformer 113, a DC output detector 114, a first output error detector 115, an electrical connector 221, and so forth.

The AC power source 140 outputs an alternating current voltage to form an alternating electric field in the secondary transfer nip N. The AC power source 140 includes an AC output controller 141, an AC driving device 142, an AC voltage transformer 143, an AC output detector 144, a remover 145, a second output error detector 146, electrical connectors 242 and 243, and so forth.

The power source controller 200 controls the DC power source 110 and the AC power source 140, and is equipped with a central processing unit (CPU), a Read Only Memory (ROM), a Random Access Memory (RAM), and so forth. The power source controller 200 inputs a DC_PWM signal to the DC output controller 111. The DC_PWM signal controls an output level of the DC voltage. Furthermore, an output value of the DC voltage transformer 113 detected by the DC output detector 114 is provided to the DC output controller 111. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal.

The DC driving device 112 drives the DC voltage transformer 113 in accordance with the instruction from the DC output controller 111. The DC driving device 112 drives the DC voltage transformer 113 to output a DC high voltage having a negative polarity. In a case in which the AC power source 140 is not connected, the electrical connector 221 and the secondary-transfer first roller 33 are electrically connected by a harness 301 so that the DC voltage transformer 113 outputs (applies) a DC voltage to the secondary-transfer first roller 33 via the harness 301. In a case in which the AC power source 140 is connected, the electrical connector 221 and the electrical connector 242 are electrically connected by a harness 302 so that the DC voltage transformer 113 outputs a DC voltage to the AC power source 140 via the harness 302.

The DC output detector 114 detects and outputs an output value of the DC high voltage from the DC voltage transformer 113 to the DC output controller 111. The DC output detector 114 outputs the detected output value as a FB_DC signal (feedback signal) to the power source controller 200 to control the duty of the DC_PWM signal in the power source controller 200 so as not to impair transferability due to environment and load. According to the present illustrative embodiment, the AC power source 140 is detachably mountable relative to the main body of the secondary transfer power source 39. Thus, an impedance in the output path of the high voltage output is different between when the AC power source 140 is connected and when the AC power source 140 is not connected. Consequently, when the DC power source 110 outputs the DC voltage under constant voltage control, the impedance in the output path changes depending on the presence of the AC power source 140, thereby changing a division ratio. Furthermore, the high voltage to be applied to the secondary-transfer first roller 33 varies, causing the transferability to vary depending on the presence of the AC power source 140.

In view of the above, according to the present illustrative embodiment, the DC power source 110 outputs the DC voltage under constant current control, and the output voltage is changed depending on the presence of the AC power source 140. With this configuration, even when the impedance in the output path changes, the high voltage to be applied to the secondary-transfer first roller 33 is kept constant, thereby maintaining reliably the transferability irrespective of the presence of the AC power source 140. Furthermore, the AC power source 140 can be detached and attached without changing the DC_PWM signal value. According to the present illustrative embodiment, the DC power source 110 is under constant-current control. Alternatively, in some embodiments, the DC power source 110 can be under constant voltage control as long as the high voltage to be applied to the secondary-transfer first roller 33 is kept constant by changing the DC_PWM signal value upon detachment and attachment of the AC power source 140 or the like.

The first output error detector 115 is disposed on an output line of the DC power source 110. When an output error occurs due to a ground fault or other problems in an electrical system, the first output error detector 115 outputs an SC signal indicating the output error such as leakage. With this configuration, the power source controller 200 can stop the DC power source 110 to output the high voltage.

The power source controller 200 inputs an AC_PWM signal and an output value of the AC voltage transformer 143 detected by the AC output detector 144. The AC_PWM signal controls an output level of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal.

An AC_CLK signal to control the output frequency of the AC voltage is input to the AC driving device 142. The AC driving device 142 drives the AC voltage transformer 143 in accordance with the instruction from the AC output controller 141 and the AC_CLK signal. As the AC driving device 142 drives the AC voltage transformer 143 in accordance with the AC_CLK signal, the output waveform generated by the AC voltage transformer 143 is adjusted to a desired frequency instructed by the AC_CLK signal.

The AC driving device 142 drives the AC voltage transformer 143 to generate an AC voltage, and the AC voltage transformer 143 then generates a superimposed voltage in which the generated AC voltage and the DC high voltage output from the DC voltage transformer 113 are superimposed. In a case in which the AC power source 140 is connected, that is, the electrical connector 243 and the secondary-transfer first roller 33 are electrically connected by the harness 301, the AC voltage transformer 143 outputs (applies) the thus-obtained superimposed voltage to the secondary-transfer first roller 33 via the harness 301. In a case in which the AC voltage transformer 143 does not generate the AC voltage, the AC voltage transformer 143 outputs (applies) the DC high voltage output from the DC voltage transformer 113 to the secondary-transfer first roller 33 via the harness 301. Subsequently, the voltage (the superimposed voltage or the DC voltage) provided to the secondary-transfer first roller 33 returns to the DC power source 110 via the secondary-transfer second roller 36.

The AC output detector 144 detects and outputs an output value of the AC voltage from the AC voltage transformer 143 to the AC output controller 141. The AC output detector 144 outputs the detected output value as a FB_AC signal (feedback signal) to the power source controller 200 to control the duty of the AC_PWM signal in the power source controller 200 to prevent the transferability from dropping due to environment and load. The AC power source 140 carries out constant voltage control. Alternatively, in some embodiments, the AC power source 140 may carry out constant current control. The waveform of the AC voltage generated by the AC voltage transformer 143 (the AC power source 140) is either a sine wave or a square wave. According to the present illustrative embodiment, the waveform of the AC voltage is a short-pulse square wave. The AC voltage having a short-pulse square wave can enhance image quality.

Figure 6:
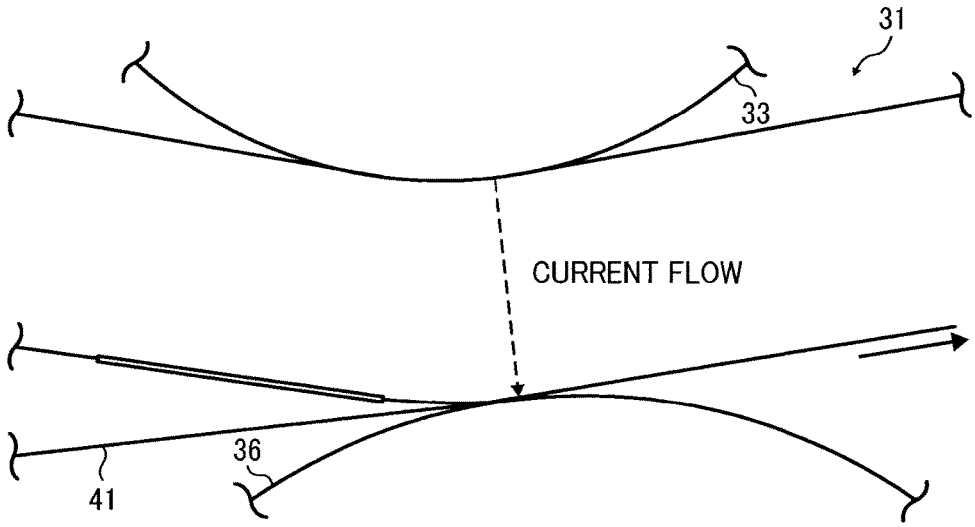
FIG. 6 is a partially enlarged cross-sectional view of a secondary transfer nip and a surrounding structure in a configuration employing a single-layer intermediate transfer belt which is different from the intermediate transfer belt of the image forming apparatus of FIG. 1.

FIG. 6 is an enlarged diagram schematically illustrating a structure around the secondary transfer nip using a single-layer intermediate transfer belt as the intermediate transfer belt 31. In a case in which the single-layer intermediate transfer belt is used as the intermediate transfer belt 31, a secondary transfer current flows between the secondary-transfer first roller 33 and the secondary-transfer second roller 36 in a manner described below. That is, the secondary transfer current is concentrated at the nip center (the center in the traveling direction of the belt) and flows linearly as indicated by an arrow in FIG. 6. In other words, the secondary transfer current does not flow much near the nip start portion of the secondary transfer nip and near the nip end portion of the secondary transfer nip. When the secondary transfer current flows in such a manner described above, the time period during which the secondary transfer current acts on the toner is relatively short at the secondary transfer nip. Accordingly, excessive injection of electrical charges having a polarity opposite that of the normal polarity due to the secondary transfer current is suppressed, if not prevented entirely.

Figure 7:
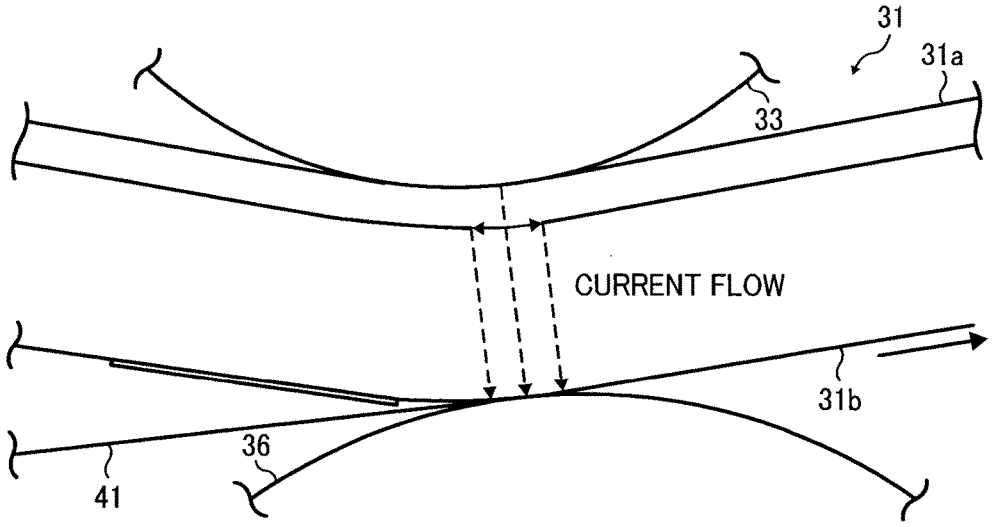
FIG. 7 is a partially enlarged cross-sectional view of a secondary transfer nip and a surrounding structure in the image forming apparatus according to the first embodiment of the present disclosure.

FIG. 7 is a partially enlarged cross-sectional view schematically illustrating the secondary transfer nip and a surrounding structure in the image forming apparatus 1000 according to the first embodiment of the present disclosure. According to the first embodiment, as described above, a multi-layer intermediate transfer belt is used as the intermediate transfer belt 31. In a case in which the multi-layer intermediate transfer belt is used as the intermediate transfer belt 31, a secondary transfer current flows between the secondary-transfer first roller 33 and the secondary-transfer second roller 36 in a manner described below. When using the multilayer intermediate transfer belt as the intermediate transfer belt 31, the secondary transfer current flows through an interface between the base layer 31*a* and the elastic layer 31*b* in the belt thickness direction while the secondary transfer current spreads in the circumferential direction of the intermediate transfer belt 31. As a result, the secondary transfer current flows not only in the center of the secondary transfer nip, but also at the nip start portion and at the nip end portion. This means that the secondary transfer current acts on the toner in the secondary transfer nip for an extended period of time. Thus, electrical charges having a polarity opposite to the normal polarity are easily and excessively injected to the toner due to the secondary transfer current, which results in a significant decrease in the amount of charge of the toner having the normal polarity and also results in a reverse charging of the toner. In both cases, the secondary transfer ability is impaired. As a result, the image density becomes inadequate easily. Not only the two-layer belt such as in the present illustrative embodiment, but also the belt having multiple layers including three more layers causes the similar spread of the secondary transfer current, which also impairs the secondary transfer ability.

Figure 8:
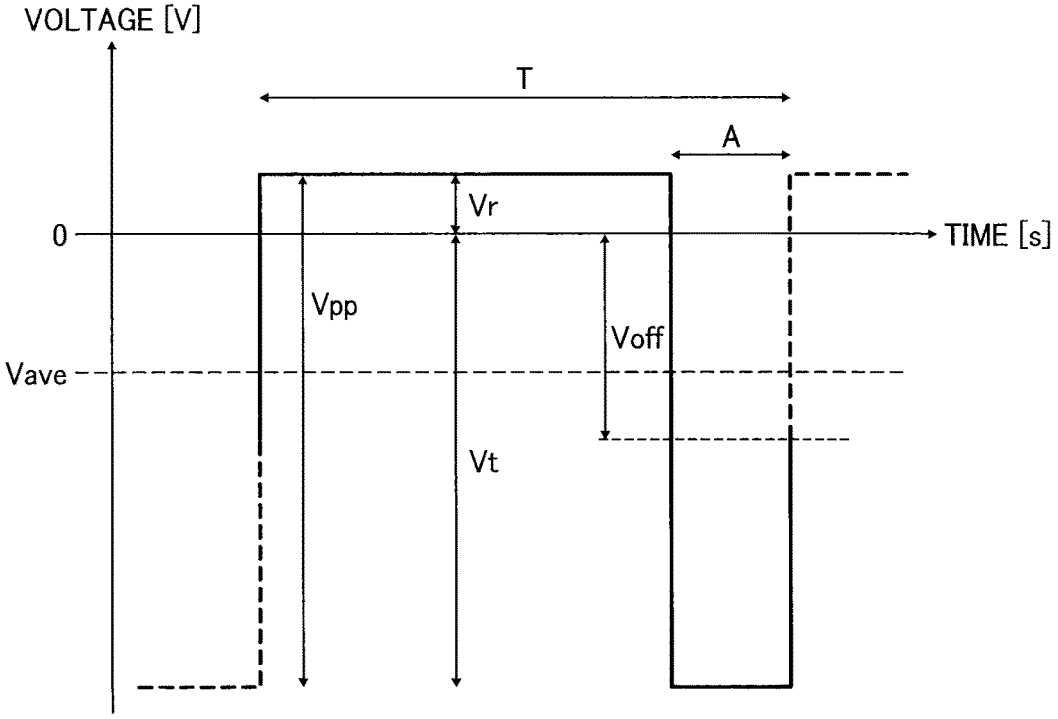
FIG. 8 is a waveform chart of a secondary transfer bias output from a secondary transfer power source according to an illustrative embodiment of the present disclosure.

Below, a further description is provided of a configuration of the image forming apparatus 1000 according to the first embodiment of the present disclosure. FIG. 8 is a waveform chart showing a waveform of a secondary bias output from the secondary transfer power source 39 in the image forming apparatus 1000 according to the first embodiment of the present disclosure. According to the first embodiment, the secondary transfer bias is applied to the secondary-transfer first roller 33. In this configuration, in order to secondarily transfer a toner image from the intermediate transfer belt 31 onto a recording sheet P, it is necessary to employ the secondary transfer bias having the characteristics described below. That is, a time-averaged polarity of the secondary transfer bias is similar to or the same polarity as the charge polarity of toner. More specifically, as illustrated in FIG. 8, the secondary transfer bias includes an alternating voltage, the polarity of which is inverted cyclically due to superimposed DC and AC voltages. On time average (average potential Vave), the polarity of the secondary transfer bias is negative which is the same as the polarity of the toner. As described above, using the secondary transfer bias having the negative time-averaged polarity, the toner is repelled relatively by the secondary-transfer first roller 33, thereby enabling the toner to electrostatically move from the belt side toward the recording sheet side. In a case in which the secondary transfer bias is applied to the secondary-transfer second roller 36, the secondary transfer bias having the time-averaged polarity opposite to the polarity of the toner is used. With such a secondary transfer bias, the toner is electrostatically attracted relatively to the secondary-transfer second roller 36, thereby enabling the toner to electrostatically move from the belt side toward the recording sheet side.

In FIG. 8, T represents one cycle of the secondary transfer bias with the polarity that alternates cyclically. In FIG. 8, Vt represents transfer peak value. The transfer peak value Vt is one peak value to apply more electrostatic force to toner in the secondary transfer nip in a transfer direction from the transfer belt 31 to the sheet conveyor belt 41, of two peak values in a peak-to-peak of the secondary transfer bias. Vr is an opposite peak value as the other peak value. When the secondary transfer bias has a positive polarity opposite the charge polarity of toner, electrostatic migration of the toner from the belt side to the recording sheet side is inhibited. By contrast, when the secondary transfer bias has a negative polarity which is the same as the charge polarity of toner, electrostatic migration of the toner from the belt side to the recording sheet side is facilitated.

In FIG. 8, Voff represents an offset voltage as a DC component value of the secondary transfer bias and coincides with a solution to an equation (Vr+Vt)/2. Vpp represents a peak-to-peak value.

The secondary transfer bias has a waveform with a duty (i.e. duty ratio) greater than 50% in the cycle T. The duty (duty ratio) is a time ratio based on an inhibition time period during which the electrostatic migration of the toner from the intermediate transfer belt side to the recording sheet side in the secondary transfer nip is inhibited in a first time period and a second time period of the waveform. According to the present illustrative embodiment, the first time period is a time period in the cycle T of the waveform from when the secondary transfer bias starts rising beyond the zero line as the baseline towards the positive polarity side to a time after the secondary transfer bias falls to the zero line, but immediately before the secondary transfer bias starts falling from the zero line towards the negative polarity side. The second time period is a time period in the cycle T of the waveform from when the secondary transfer bias starts falling towards the negative polarity side from the zero line to a time after the secondary transfer bias rises to the zero line, but immediately before the secondary transfer bias starts further rising beyond the zero line towards the positive polarity side. In the first time period, the toner is prevented from electrostatically moving from the belt side to the recording sheet P side. In other words, the first time period corresponds to the inhibition time period. Therefore, the duty is the time ratio based on the first time period (during which the polarity is positive) in the cycle T. The duty of the secondary transfer bias of the image forming apparatus 1000 is obtained by the following equation: (T−A)/T×100(%), where A is the second time period.

In FIG. 8, Vave represents an average potential of the secondary transfer bias and coincides with a solution to an equation "Vr×Duty/100+Vt×(1−Duty)/100". Furthermore, A represents the second time period (i.e., a time period obtained by subtracting the inhibition time period from the cycle T in the present illustrative embodiment.) T indicates a cycle of an alternating current component of the secondary transfer bias.

As illustrated in FIG. 8, in the secondary transfer bias, the time period during which the secondary transfer bias has a positive polarity is greater than half the cycle T. That is, the duty is greater than 50%. With such a secondary transfer bias, the time period, during which electrical charges having the positive polarity opposite to the charge polarity of the toner may possibly be injected to the toner in the cycle T, is shortened. Accordingly, a decrease in the charge amount of toner Q/M caused by the injection of the electrical charges in the secondary transfer nip can be suppressed, if not prevented entirely. With this configuration, degradation of the secondary transfer ability caused by a decrease in the charge amount of toner is prevented, hence obtaining adequate image density. Even when the duty is greater than 50%, the toner image can be secondarily transferred in a manner described below. That is, an area of the positive side of the graph with 0V as a reference is smaller than that of the negative side of the graph so that the average potential has a negative polarity, thereby enabling the toner to electrostatically move relatively from the belt side to the recording sheet side.

Figure 9:
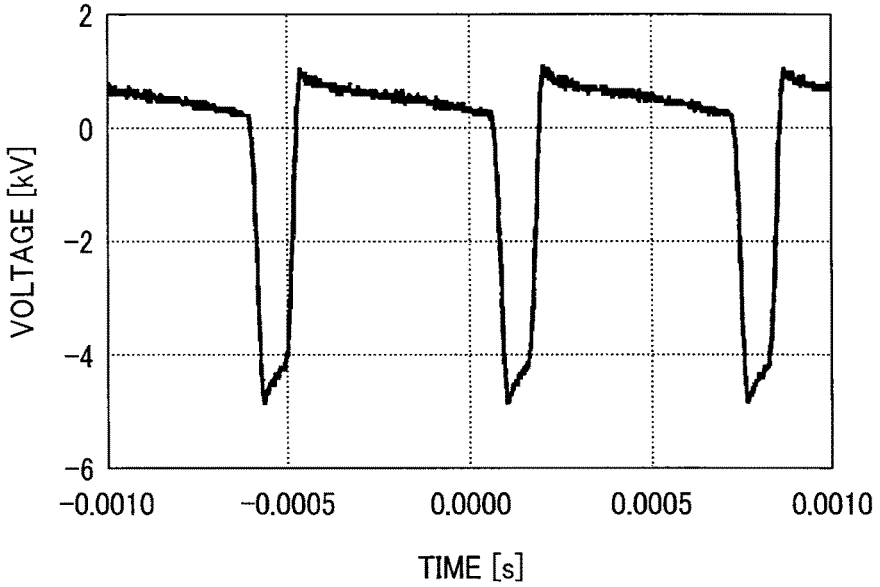
FIG. 9 is a waveform chart of a secondary transfer bias with a duty of 85% output from a secondary transfer power source of a prototype image forming apparatus.

FIG. 9 is a waveform chart showing a waveform of the secondary transfer bias output from the secondary transfer power source 39 of a prototype image forming apparatus. In FIG. 9, the transfer peak value Vt is −4.8 kV. The opposite peak value Vr is 1.2 kV. The offset voltage Voff is −1.8 kV. The average potential Vave is 0.08 kV. The peak-to-peak value Vpp is 6.0 kV. The second time period A is 0.10 ms. The cycle T is 0.66 ms. The duty is 85%.

The present inventors have performed printing tests with different duties of the secondary transfer bias under the following conditions:

- Environment condition (temperature/humidity): 27° C./80%
- Type of recording sheet P: Coated sheet, i.e., Mohawk Color Copy Gloss 270 gsm (457 mm×305 mm)
- Process linear velocity: 630 mm/s
- Test image: Black halftone image
- Width of the secondary transfer nip (the length in the traveling direction of the belt): 4 mm
- Transfer peak value Vt: −4.8 kV
- Opposite peak value Vr: 1.2 kV
- Offset voltage Voff: −1.8 kV
- Average potential Vave: 0.08 kV
- Peak-to-peak value Vpp: 6.0 kV
- Second time period A: 0.10 ms
- Cycle T: 0.66 ms Duty: 90%, 70%, 50%, 30%, 10%

Figure 10:
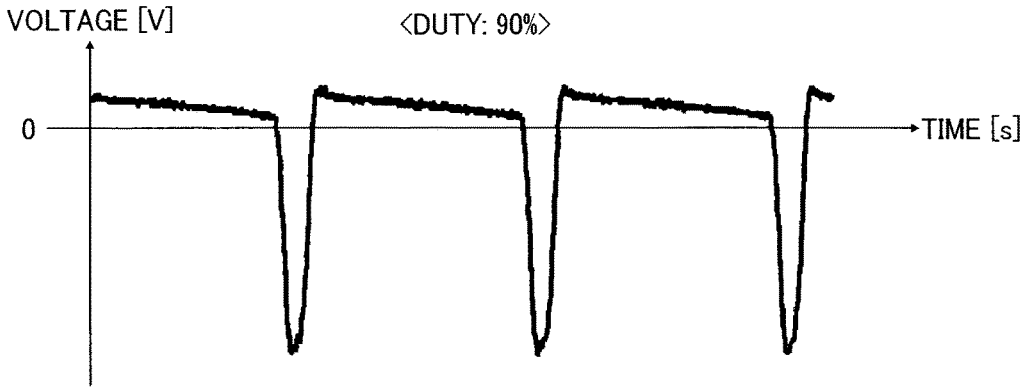
FIG. 10 is a waveform chart of a secondary transfer bias with a duty of 90% output from the secondary transfer power source of the prototype image forming apparatus.
Figure 11:
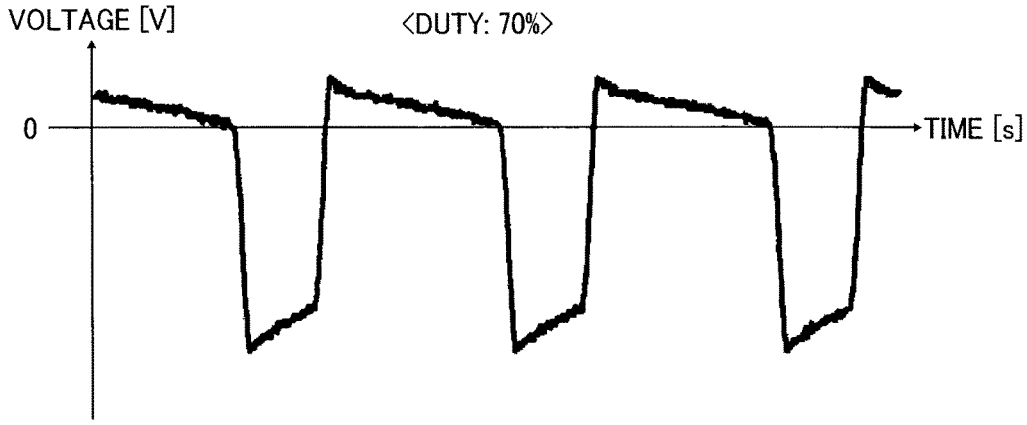
FIG. 11 is a waveform chart of a secondary transfer bias with a duty of 70% output from the secondary transfer power source of the prototype image forming apparatus.
Figure 12:
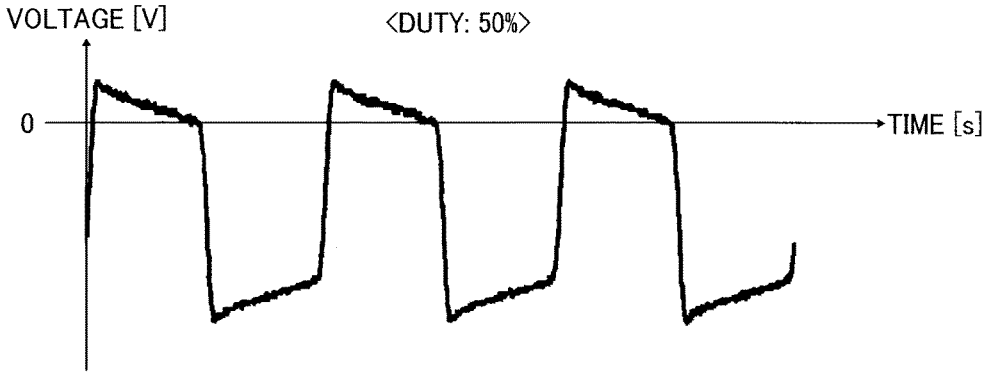
FIG. 12 is a waveform chart of a secondary transfer bias with a duty of 50% output from the secondary transfer power source of the prototype image forming apparatus.
Figure 13:
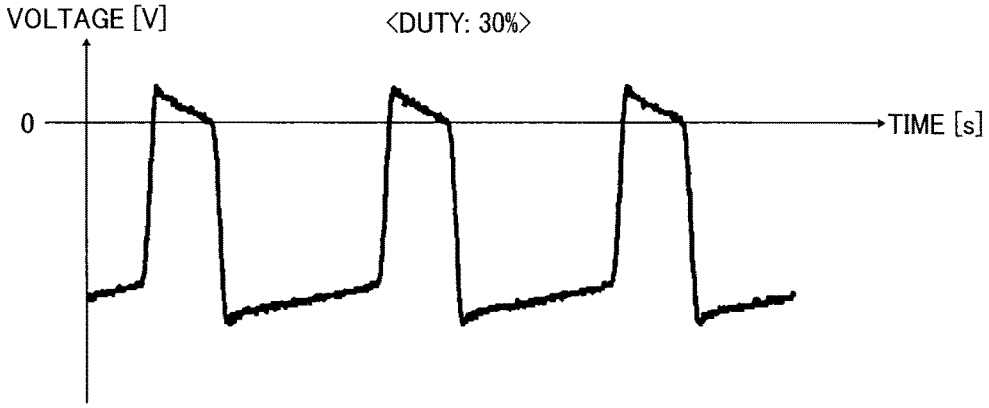
FIG. 13 is a waveform chart of a secondary transfer bias with a duty of 30% output from the secondary transfer power source of the prototype image forming apparatus.
Figure 14:
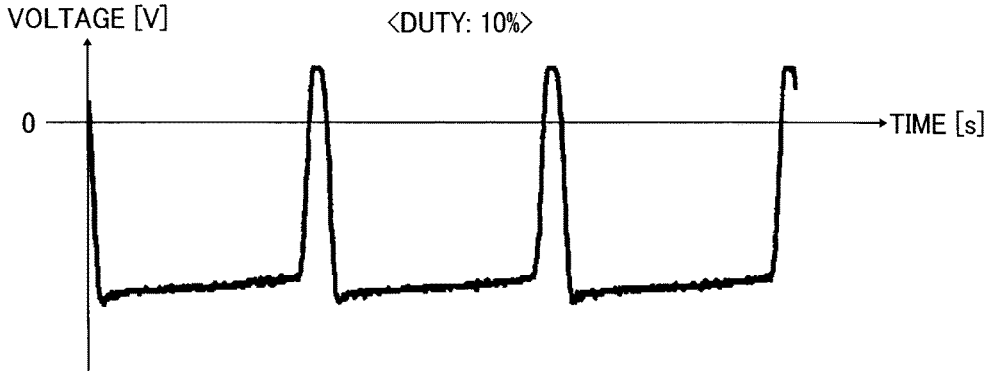
FIG. 14 is a waveform chart of a secondary bias with a duty of 10% output from the secondary transfer power source of the prototype image forming apparatus.

FIG. 10 is a waveform chart of an actual output waveform of the secondary transfer bias with the duty of 90%. FIG. 11 is a waveform chart of an actual output waveform of the secondary transfer bias with the duty of 70%. FIG. 12 is a waveform chart of an actual output waveform of the secondary transfer bias with the duty of 50%. FIG. 13 is a waveform chart of an actual output waveform of the secondary transfer bias with the duty of 30%. FIG. 14 is a waveform chart of an actual output waveform of the secondary transfer bias with the duty of 10%.

The results of the first experiment are shown in Table 1.

TABLE 1

| | DUTY (%) | | | | |
|---|---|---|---|---|---|
| | 90 | 70 | 50 | 30 | 10 |
| EVALUATION OF TRANSFERABILITY | 5 | 5 | 3 | 1 | 10 |

In Table 1, reproducibility of image density of test images were graded on a five point scale of 1 to 5, with Grade 5 indicating that the density of a halftone test image was adequate. Grade 4 indicates that the density was slightly lower than that of Grade 5, but the density was good enough so as not to cause a problem. Grade 3 indicates that the density was lower than that of Grade 4, and desired image quality to satisfy users was not obtained. Grade 2 indicates that the density was lower than that of Grade 3. Grade 1 indicates that the test image looked generally white or even whiter (less density). The acceptable image quality to satisfy users was Grade 4 or above.

With the duty of 10% and 30%, the time period, during which electrical charges having the opposite polarity may possibly be injected to the toner in the cycle T, was relatively long. Therefore, a decrease in the charge amount of toner Q/M due to the injection of reverse electrical charges was significant. As a result, as shown in Table 1, the image density was graded as Grade 1 which indicates that the image density was inadequate significantly.

By contrast, with the duty of 70% and 90%, the time period, during which electrical charges having the opposite polarity may possibly be injected to the toner in the cycle T, was relatively short. Therefore, a decrease in the charge amount of toner Q/M due to the injection of reverse electrical charges was suppressed effectively. As a result, as shown in Table 1, the image density was graded as Grade 5 which indicates that the desired image density was obtained.

As shown in the drawings, with the secondary transfer bias, the polarity of which alternately changes in the cycle T, the injection of reverse electrical charges to the toner can be prevented more reliably. In this configuration, even when the recording sheet P is charged the electric field having the polarity that prevents the injection of the reverse charges acts relatively in the secondary transfer nip.

The same experiments were performed using regular paper, instead of the above-described coated sheets. The experiment conditions are described below.

Environment condition (temperature/humidity): 27° C./80%
Type of recording sheet: Normal (regular paper)
Process linear velocity: 630 mm/s
Test image: Black halftone image
Width of the secondary transfer nip (the length in the traveling direction of the belt): 4 mm
Transfer peak value Vt: −4.8 kV
Opposite peak value Vr: 1.2 kV
Offset voltage Voff: −1.8 kV
Average potential Vave: 0.08 kV
Peak-to-peak value Vpp: 6.0 kV
Second time period A: 0.10 ms
Cycle T: 0.66 ms
Duty: 90%, 70%, 50%, 30%, 10%

The relations between the duty and the evaluation of the transferability were similar to the coated sheet shown in Table 1.

Generally, as illustrated in FIGS. 9 through 14, the waveform of the secondary transfer bias consisting of a superimposed voltage is not a clean square wave. If the waveform is a clean square wave, a time period from the rise of waveform to the fall of the waveform can be easily specified as the toner-transfer inhibition time period in one cycle. If the waveform is not such a clean square wave, the inhibition time period cannot be specified. That is, in a case in which a certain amount of time period is required (i.e., when the required time period is not zero) for the wave to rise from a first peak value (for example, the transfer peak value Vt) to a second peak value (for example, the opposite peak Vr), or to fall from the second peak value to the first peak value, the above-described specifying process cannot be performed. In view of the above, if the waveform is not a clean square wave, the duty is defined as follows. That is, among one peak value (e.g., the first peak value) of the peak-to-peak value and another peak value (e.g., the second peak value) in the cyclical movement of the waveform of the secondary transfer bias, whichever inhibits more the electrostatic migration of toner from the belt side to the recording sheet side in the secondary transfer nip, is defined as an inhibition peak value. According to the first embodiment, the peak value at the positive side is defined as the inhibition peak value. The position, at which the inhibition peak value is shifted towards the another peak value by an amount equal to 30% of the peak-to-peak value, is defined as the baseline of the waveform. A time period, during which the waveform is on the inhibition peak side relative to the baseline, is defined as an inhibition time period A'. More specifically, the inhibition time period A' is a time period from when the waveform starts rising or falling from the baseline towards the inhibition peak value to immediately before the waveform falls or rises to the baseline. The duty is defined as a ratio of the inhibition time period A' to the cycle T.

Figure 15:
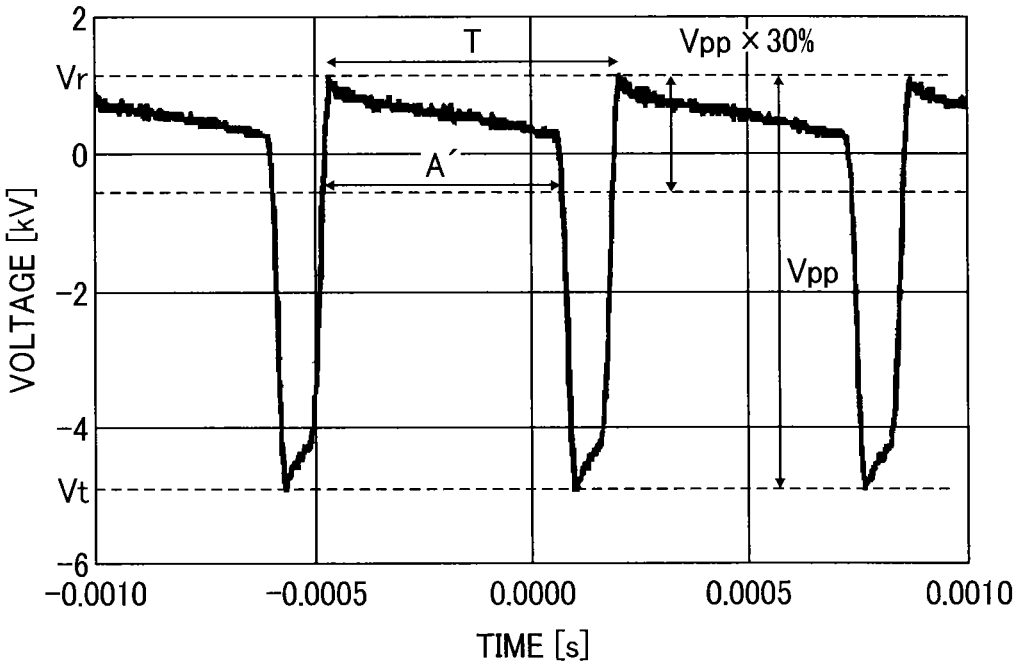
FIG. 15 is a graph of a definition of the duty.

More specifically, a solution of an equation "(Inhibition time period A'/Cycle T)×100%" in FIG. 15 is obtained as the duty. According to the first embodiment, the toner having a negative polarity is used, and the secondary transfer bias is applied to the secondary-transfer first roller 33. Thus, the opposite peak value Vr is the inhibition peak value. The inhibition time period A' is a time period from when the waveform starts rising from the baseline towards the opposite peak value Vr to a time after the waveform falls to the baseline, but immediately before the waveform starts falling further towards the transfer peak value Vt. By contrast, in a configuration in which the toner having a negative polarity is used and the secondary transfer bias is applied to the secondary-transfer second roller 36, the secondary transfer bias having a reversed waveform which is a waveform shown in FIG. 15 reversed at 0 V as a reference is used. In this case, the transfer peak value Vt is the inhibition peak value. The inhibition time period A' is a time period from when the waveform starts falling from the baseline towards the transfer peak value Vt to a time after the waveform rises to the baseline, but immediately before the waveform starts rising further towards the opposite peak value Vr.

According to the first embodiment, as the intermediate transfer belt 31, a belt with an upper most layer (i.e., the elastic layer 31*b*) in which particles (the particles 31*c*) are dispersed is used. With this configuration, a contact area of the belt surface with the toner in the secondary transfer nip can be reduced, and hence the ability of separation of the toner from the belt surface can be enhanced. The transfer rate can be enhanced. However, when the secondary transfer current flows concentrically between the insulating particles 31*c* which are arranged regularly, the electrical charges having an opposite polarity get injected easily to the toner. As a result, even when the particles 31*c* are dispersed to enhance the transfer rate, the secondary transfer rate may decrease. In view of this, the secondary transfer bias with a high duty is employed to reliably enhance the secondary transfer rate by the particles 31*c*.

As the particles 31*c*, particles capable of getting oppositely charged to the normal charging polarity of the toner having an opposite charging property According to the first embodiment, the particles 31*c* are constituted of melamine resin particles having a positive charging property. With this configuration, electrical charges of the particles 31*c* suppress concentration of the secondary transfer current between the particles, hence further reducing the injection of opposite electrical charges to the toner.

Alternatively, in some embodiments, particles having charge property of the same charge polarity as the normal charge polarity of the toner are used as the particles 31*c*. For example, silicone resin particles having a negative charge property (i.e., Tospearl (trade name)) can be used.

In some embodiments, the intermediate transfer belt 31 may include an uppermost layer made of urethane or Teflon®. Alternatively, the intermediate transfer belt 31 may include multiple layers made of resins such as polyimide and polyamide-imide. With either belts, using the secondary transfer bias with a high duty can prevent insufficient image density due to application of charge of the opposite polarity to toner at the secondary transfer nip.

As described above, when using the intermediate transfer belt 31 in which the elastic layer 31*b* laminated on the base layer 31*a* is flexibly deformable in conformity to the uneven surface of the recording sheet P in the secondary transfer nip, theoretically, the following effect can be obtained. Specifically, even when using an uneven surface sheet as the recording sheet P, toner is secondarily transferred to recessed portions in the sheet surface in a favorable manner, thus reducing the occurrence of uneven image density due to an insufficient amount of toner in the recessed portions. In addition, by using as the secondary transfer bias a bias including a superimposed voltage in which an AC voltage is superimposed on a DC voltage, it is possible to reduce the occurrence of insufficient image density due to implantation of an opposite polarity charge to the toner at the secondary transfer nip.

However, the inventors of the present application have performed test printing of printing a test image on the uneven surface sheet by using a prototype image forming apparatus using the intermediate transfer belt 31 in which the elastic layer 31*b* is laminated on the base layer 31*a*, and have found unexpected results. That is, in recessed portions of the surface of the uneven surface sheet, a sufficient image density is obtained due to transfer of a sufficient amount of toner. In contrast, in raised portions of the uneven surface sheet, the amount of toner transferred becomes insufficient, thus causing an image density failure.

For example, for an image forming apparatus employing a single-layer structure intermediate transfer belt including carbon dispersed polyimide, a surface of the intermediate transfer belt may not deform in conformity to the uneven surface of the uneven surface sheet at the secondary transfer nip. Accordingly, minute gaps are formed between the recessed portions of the surface of the uneven surface sheet and the surface of the intermediate transfer belt at the secondary transfer nip, and thus the amount of toner in the recessed portions of the surface of the uneven surface sheet is likely to be insufficient. Hence, a bias including a superimposed voltage is used as the secondary transfer bias so as to transfer a sufficient amount of toner into the recessed portions of the surface of the uneven surface sheet, thus allowing toner to reciprocally move between the belt surface and the recessed portions of the surface of the recording sheet. During the reciprocal movement, toner particles, which are transferred from the inside of the recessed portions of the surface of the uneven surface sheet, collide with toner particles adhered to the belt surface to gradually increase the amount of toner that is transferred to the inside of the recessed portions in accordance with the reciprocal movement, thereby finally transferring a sufficient amount of toner into the recessed portions of the surface of the uneven surface sheet.

In contrast, for the image forming apparatus 1000 according to the first embodiment, the elastic layer 31*b* is flexibly deformed in the nip to favorably fit the elastic layer 31*b* into the recessed surface portions of the uneven surface sheet. Accordingly, even when a bias including only a DC voltage instead of a bias including a superimposed voltage is used as the secondary transfer bias, a sufficient amount of toner is transferred into the recessed portions of the surface of the uneven surface sheet. However, as described above, in the case of using the secondary transfer bias including only a DC voltage, when using a recording sheet P other than an uneven surface sheet such as a coated sheet and a plain paper sheet, an insufficient image density occurs due to implantation of opposite polarity charges to the toner at the secondary transfer nip. The insufficient image density may cause an insufficient amount of toner at the entirety of the sheet surface regardless of a difference between recessed portion and non-recessed portion.

The above-described image forming apparatus employing the single-layer structure intermediate transfer belt including carbon dispersed polyimide uses a secondary transfer bias including a superimposed voltage so as to obtain favorable transferability with the uneven surface sheet. In contrast, the image forming apparatus 1000 according to the present embodiment uses a secondary transfer bias including a superimposed voltage so as to obtain favorable transferability with a plain paper sheet. That is, the above-described image forming apparatus employing the single-layer structure intermediate transfer belt and the image forming apparatus according to the present embodiment use a secondary transfer bias including a superimposed voltage so as to cope with recording sheets having characteristics opposite to each other.

Figure 16:
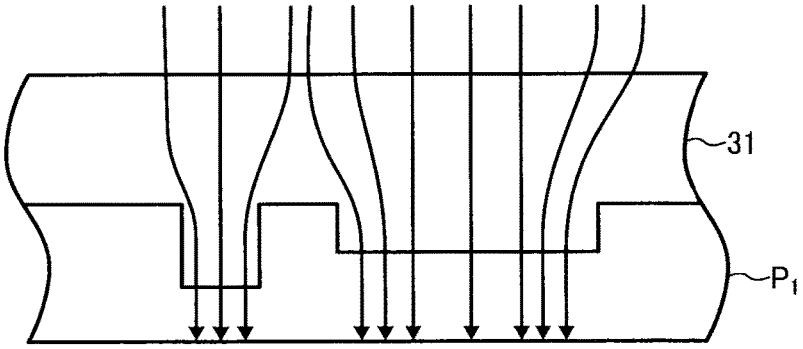
FIG. 16 is a schematic cross-sectional view of a fit state between a surface of an uneven surface sheet and the intermediate transfer belt in the secondary transfer nip of the image forming apparatus.

FIG. 16 is a schematic cross-sectional view of a fit state between a surface of an uneven surface sheet $P_1$ and the intermediate transfer belt 31 in the secondary transfer nip of the image forming apparatus 1000 according to the first embodiment. In the uneven surface sheet $P_1$, the thickness of a site of recessed portions of the surface is smaller than the thickness of a site of raised portions of the surface in a sheet surface direction, and thus a volume specific resistance value of the former site is smaller than a volume specific resistance value of the later site. With respect to the uneven surface sheet $P_1$, the intermediate transfer belt 31 preferably fits not only the raised surface portions but also the recessed surface portions due to flexible deformation of the elastic layer as illustrated in FIG. 16. In this case, in the entirety of the sheet surface, a secondary transfer current concentrically flows to a site of the recessed surface portion having a relatively high volume specific resistance value of the sheet in comparison to a site of the raised surface portions having a relatively low volume specific resistance value of the sheet as indicated by arrows in FIG. 16. Accordingly, it is considered that a sufficient amount of secondary transfer current does not flow to toner that exists on the raised surface portions, and thus insufficient image density occurs at the raised surface portions.

To reduce occurrence of insufficient image density at the raised surface portions, the inventors of the present application have performed a second experiment in which the electric field intensity in a transfer direction is increased by increasing a value (absolute value) of a DC component of a secondary transfer bias including a superimposed voltage in the case of using the uneven surface sheet. In this case, it is possible to increase the amount of toner transferred to the raised surface portions, but in an obtained abnormal image, a lot of dot-shaped white spots are present. The reason for this result is as follows. When a value of a DC component becomes larger, a transfer peak value ($V_t$) becomes larger than a transfer peak value during discharge initiation between a surface of the intermediate transfer belt 31 and the raised surface portions of the uneven surface sheet or the recessed surface portions, and thus electric discharge occurs between the surfaces at timing at which it reaches the transfer peak value ($V_t$). At a site of the discharge, toner is charged with the opposite polarity at a time, and thus the white spots occur. Under the same secondary transfer bias conditions, the abnormal image with dot-shaped white spots also occurs in the recording sheet P other than the uneven surface sheet without being limited to the case of using the uneven surface sheet.

As described above, in a configuration in which the intermediate transfer belt 31, in which the elastic layer 31*b* is laminated on the base layer 31*a*, is used so as to improve the toner transferability to the recessed surface portions of the uneven surface sheet, the following phenomenon occurs. Specifically, in the case of using the recording sheet P other than the uneven surface sheet, it is assumed that a superimposed voltage is used as the secondary transfer bias so as to reduce occurrence of an image density failure at the entirety of the sheet surface due to implantation of charges of a polarity opposite a polarity of toner in the secondary transfer nip. In the case of using the uneven surface sheet, the secondary transfer current is concentrated to the recessed surface portions of the entire sheet surface, and thus insufficient image density occurs at the raised surface portions. In contrast, in the case of using the uneven surface sheet, when a value of the DC component in the secondary transfer bias including a superimposed voltage is further increased so as to reduce occurrence of insufficient image density at the raised surface portions, the abnormal image with dot-shaped white spots occurs at the uneven surface sheet or other recording sheet P.

The inventors of the present application have performed a third experiment in which test printing is performed under various conditions by using the prototype image forming apparatus. In the third experiment, the secondary transfer bias was appropriately switched between a secondary transfer bias including only a DC voltage, a secondary transfer bias including a high-duty superimposed voltage in which duty is set to be greater than 50%, and a secondary transfer bias including a low-duty superimposed voltage in which duty is set to 50% or less. In addition, the intermediate transfer belt 31 was switched between a multi-layer belt configuration having the same multi-layer structure as in the image forming apparatus 1000 according to the first embodiment, and a single-layer belt configuration including only a base layer. In addition, the recording sheet P was appropriately switched between a configuration of an uneven surface sheet (Leathac 66, manufactured by Tokushu Tokai Paper Co., Ltd.), and a configuration of a plain paper sheet. Under respective conditions, a test image was printed onto the recording sheet P, and the toner transferability was evaluated as three grades including "good", "fair", and "poor". In the case of using the uneven surface sheet, toner transferability to the recessed surface portions, and the toner transferability to the raised surface portions were evaluated, respectively. In addition, in the case of using the plain paper sheet, the transferability of toner to smooth surface portions of the plain paper sheet were evaluated.

Results of the third experiment are listed in Table 2.

TABLE 2

| | Secondary Transfer Bias | DC | High-duty AC/DC | Low-duty AC/DC | Toner Transferability |
|---|---|---|---|---|---|
| Intermediate Transfer Belt | Multi-layer belt | Good | Good | Good | Recessed Surface portion |
| | | Good | Poor | Poor | Raised Surface portion |
| | | Poor | Good | Poor | Smooth surface portion |
| | Single-layer belt | Poor | Fair | Good | Recessed Surface portion |
| | | Good | Fair | Good | Raised Surface portion |
| | | Good | — | Fair | Smooth surface portion |

As listed in Table 2, in the case of using a bias (DC) including only a DC voltage as the secondary transfer bias, and the multi-layer belt, favorable toner transferability is obtained at the recessed surface portions or the raised surface portions of the sheet, but the toner transferability deteriorates at the smooth surface portions of the plain paper sheet. The reason for this is because the opposite polarity charges are implanted to toner at the secondary transfer nip. Even in the case of using the secondary transfer bias including only a DC voltage, if using a single-layer belt, opposite results are obtained. Accordingly, favorable toner transferability is obtained at the raised surface portions of the uneven surface sheet, but the toner transferability is poor at the recessed surface portions of the uneven surface sheet. The reason for this is because gaps occur between a surface of the single-layer belt which is less likely to deform, and the recessed surface portions of the uneven surface sheet, and thus it is difficult to form a transfer electric field with sufficient intensity. In the case of a belt having an elastic layer on a surface, the above-described gap does not occur, and thus the transfer electric field with sufficient intensity is formed at the recessed portions. As a result, toner can be secondarily transferred in a favorable manner.

As is the case with the image forming apparatus 1000 according to the first embodiment, when referring to the case of using the multi-layer belt as the intermediate transfer belt 31, it can be understood as follows. Specifically, in the case of using the uneven surface sheet, even when using either a bias including only a DC voltage or a bias (AC/DC) including a superimposed voltage as the secondary transfer bias, it is possible to obtain favorable toner transferability with respect to the recessed surface portions. However, when using the secondary transfer bias including a superimposed voltage regardless of duty with respect to the raised surface portions, the toner transferability deteriorates. It is necessary to use the secondary transfer bias including a DC voltage so as to obtain favorable toner transferability at the raised surface portions.

Furthermore, results listed in Table 2 are obtained under a standard environment of a temperature of 25° C. and humidity of 50%. The inventors of the present application have performed the same experiment by using the intermediate transfer belt 31, which is constituted by the multi-layer belt, by setting a laboratory environment as a low-temperature and low-humidity environment. As a result, they found that when using a bias including a superimposed voltage as the secondary transfer bias, insufficient image density occurs. The reason for this is because the transfer peak value ($V_t$) excessively increases, and thus a lot of dot-shaped white spots caused by discharge occurs, and as a result, the image density significantly decreases. When using the secondary transfer bias including only a DC voltage instead of the secondary transfer bias including a superimposed voltage, a favorable image density without the dot-shaped white spots could be obtained. The inventors of the present application have performed the same experiment by variously changing the environment, and have obtained the following finding. Specifically, in a case where absolute humidity is lower than 6 g/m$^3$, it is necessary to use a secondary transfer bias including only a DC voltage. In contrast, in a case where the absolute humidity is 6 g/m$^3$ or higher, it is necessary to use a secondary transfer bias including a superimposed voltage.

As illustrated in FIG. 5, an environment sensor 500 is connected to the power source controller 200. The environment sensor 500 detects a temperature inside the image forming apparatus 1000 and transmits the result to the power source controller 200, or detects relative humidity and transfers the result to the power source controller 200. The power source controller 200 calculates absolute humidity inside the image forming apparatus 1000 from the temperature and the relative humidity which are obtained on the basis of signals transmitted from the environment sensor 500.

An input operation unit 501 is also connected to the power source controller 200. When an input operation is performed by a user with respect to the input operation unit that is constituted by a touch panel, a keyboard, and the like, the power source controller 200 can acquire the following specific information. Specifically, the specific information includes information capable of specifying whether or not a recording sheet that is set in the sheet cassette 100 is an uneven surfaced sheet or the other sheets. That is, the input operation unit 501 functions as an information acquisition device that acquires the specific information. The power source controller 200 controls a secondary transfer current as illustrated in the following Table 3 on the basis of the specific information (for example, information such as using of Leathac 66) that is input to the input operation unit, and a calculation result of the absolute humidity.

TABLE 3

| | Types of Secondary Transfer Bias | | | |
|---|---|---|---|---|
| Absolute Humidity x | Plain Paper Sheet | Coated Sheet | Uneven Sheet | Other |
| x ≥ 6 g/m$^3$ | AC/DC | AC/DC | DC | AC/DC |
| x < 6 g/m$^3$ | DC | DC | DC | DC |

As a specific aspect of acquiring specific information by the input operation unit 501 and determining whether or not the specific information corresponds to the uneven surface sheet by the power source controller 200, for example, it is possible to employ any one among configurations exemplified below.

Configuration 1

A memory is connected to the power source controller 200. The memory stores a brand and unevenness data table that associates sheet brands with unevenness information indicating whether each brand is an uneven surface sheet. The power source controller 200 displays a plurality of sheet brands (for example, Leathac 66 (manufactured by Tokushu Tokai Paper Co., Ltd.), a plain paper sheet, Mohawk Color Copy Gloss, and the like) on a touch panel of the input operation unit. A user selects a brand of a sheet to be used among the brands. The power source controller 200 specifies unevenness information correlated with the brand, which is selected, from the brand unevenness data table, and determines whether or not a recording sheet, which becomes a transfer target of a toner image, is the uneven surface sheet on the basis of the result.

Configuration 2

A selection screen, which allows a user to select whether the sheet is an uneven surface sheet, is displayed on the touch panel of the input operation unit 501. The user confirms the sheet to be used through visual observation and the like, and selects "uneven surface sheet" on the touch panel in a case where the sheet is determined as the uneven surface sheet. In addition, in a case where it is determined that the sheet is not the uneven surface sheet, the user selects "sheet other than uneven surface sheet" on the tough panel.

Configuration 3

A memory is connected to the power source controller 200. The memory stores the above-described brand and unevenness data table. In addition, a determiner determining the sheet brand is provided on an upper side of the image forming apparatus 1000, and is connected to the power source controller 200. The determiner includes a switch, an optical sensor (reflective photo sensor), and a determination unit that is connected to the optical sensor. In a state in which the sheet to be used is located at a position that faces the optical sensor, when the user presses the switch, the optical sensor of the determiner irradiates a surface of the sheet with light beams, and receives reflected light beams obtained from the surface of the sheet. The determination unit determines the sheet brand on the basis of information of the reflected light beams which are received by the optical sensor. The power source controller 200 specifies unevenness information, which corresponds to the brand that is determined by the determination unit, in the brand and unevenness data table that is stored in the memory. In addition, the power source controller 200 determines whether or not the sheet of which the brand is determined by the determiner is the uneven surface sheet on the basis of the result that is specified. Furthermore, the determiner may be connected to the body of the image forming apparatus 1000 through a network instead of being provided integrally with the body of the image forming apparatus 1000.

As listed in Table 3, in a case where the absolute humidity x is 6 g/m$^3$ or higher, the power source controller 200 uses a bias including only a DC voltage as the secondary transfer bias only in a case where the uneven surface sheet is used as the recording sheet P. According to this, even in the uneven surface sheet that is likely to allow a secondary transfer current to concentrically flow to the recessed surface portions of on a sheet surface, a necessary amount of secondary transfer current is also allowed to flow to the raised surface portions, and thus it is possible to reduce occurrence of insufficient image density at the raised surface portions. In addition, in a case where a recording sheet P other than the uneven surface sheet is used, a bias including a superimposed bias is used as the secondary transfer bias, and thus it is possible to reduce occurrence of insufficient image density over the entirety of the smooth surface portions due to implantation of an opposite polarity charge to toner at the secondary transfer nip.

In addition, in a case where the absolute humidity x is lower than 6 g/m$^3$, the power source controller 200 uses a bias including only a DC voltage as the secondary transfer bias regardless of whether or not the recording sheet P is the uneven surface sheet. In the case of using a plain paper sheet, a coated sheet, and other sheets of paper in which surface unevenness does not exist, a potential difference between a belt surface and a sheet surface is retained to be less than a discharge initiation voltage to reduce occurrence of the abnormal image with a lot of dot-shaped white spots.

Furthermore, description has been given of an aspect of selecting whether or not to use a bias including only a DC voltage or a bias including a superimposed voltage as the secondary transfer bias on the basis of the absolute humidity in the case of using the recording sheet P other than the uneven surface sheet, but the following aspect may be employed. Specifically, selection of any secondary transfer bias may be performed on the basis of only the temperature, only the relative humidity, or both of the temperature and the relative humidity.

In addition, description has been given of an example in which the input operation unit 501 is used as the information acquisition device that acquires specific information, but a measurement device measuring the degree of surface unevenness of the recording sheet P may be provided, and a detection result obtained by the measurement device may be used as the specific information.

Examples of the measurement device that measures the degree of surface unevenness of the recording sheet P include a measurement device that measures the maximum unevenness difference on the surface of the recording sheet P. In addition, examples of a commercially available device of the measurement device include "SURFCOM 1400D" (manufactured by TOKYO SEIMITSU CO., LTD.). In the measurement device, five sites in the entire region of a surface are randomly selected as a region to be inspected on the basis of an image that is obtained by photographing the surface of a recording sheet with a microscope. With respect to the respective sites, the maximum cross-sectional height (Pt) (JIS B 0601: 2001) of a cross-sectional curve is measured under conditions in which an evaluation length is set to 20 mm and a reference length is set to 20 mm. In addition, an average value of top three heights among five maximum cross-sectional heights Pt, which are obtained, is obtained. The above-described processes are performed with respect to each of the front end portion, the central portion, and the rear end portion of the recording sheet P, and an average of respective average values is obtained as the maximum unevenness difference. For example, a recording sheet P of which the maximum unevenness difference (specific information) is 50 μm or greater may be specified as an uneven surface sheet, and a recording sheet P of which the maximum unevenness difference is less than 50 μm may be specified as a recording sheet other than the uneven surface sheet.

For example, in a case where the maximum unevenness difference of the recording sheet P which is measured by a measurement device is less than 50 μm, the power source controller 200 of the image forming apparatus 1000 outputs a bias including a superimposed voltage from the secondary transfer power source 39 as the secondary transfer bias. In contrast, for example, in a case where the maximum unevenness difference is 50 μm or greater, the power source controller 200 outputs a bias including only a DC voltage from the secondary transfer power source 39 as the secondary transfer bias.

Examples of other measurement devices which measure the degree of surface unevenness of the recording sheet P include a measurement device that measures smoothness on a surface of the recording sheet P. The measurement device measures the smoothness of a sheet of paper on the basis of a method described in JIS P 8119 "Testing Method For Smoothness Of Paper And Paperboard By Bekk Tester". In the measurement device, for example, five regions to be inspected are randomly selected on a sheet, and an average value of results obtained by measuring the smoothness with respect to respective regions is obtained and is set as the smoothness. In the sheet, the smaller the surface unevenness is, the greater the value of the smoothness is. For example, a recording sheet P of which the smoothness is lower than 20 seconds may be determined as the uneven surface sheet, and a recording sheet P of which the smoothness is 20 seconds or higher may be determined as a sheet other than the uneven surface sheet.

In a configuration using the above-described measurement device, for example, in a case where the smoothness of the recording sheet P, which is measured by the measurement device, is 20 seconds or higher, the power source controller 200 of the image forming apparatus 1000 outputs a bias including a superimposed voltage from the secondary transfer power source 39 as the secondary transfer bias. In contrast, for example, in a case where the smoothness is lower than 20 seconds, the power source controller 200 outputs a bias including only a DC voltage from the secondary transfer power source 39 as the secondary transfer bias. That is, in a case where the surface unevenness of the recording sheet P, which is measured with the maximum unevenness difference or the smoothness, is less than a predetermined value, the power source controller 200 outputs a bias including a superimposed voltage from the secondary transfer power source 39 as the transfer bias. On the other hand, when the surface unevenness is equal to or greater than the predetermined value, the power source controller 200 outputs a bias including only a DC voltage from the secondary transfer power source 39 as the transfer bias.

Next, a description will be given of examples in which a more specific configuration is applied to the image forming apparatus 1000 according to the first embodiment. Furthermore, the configuration of an image forming apparatus according to this example is the same as in the first embodiment unless otherwise stated.

Figure 17:
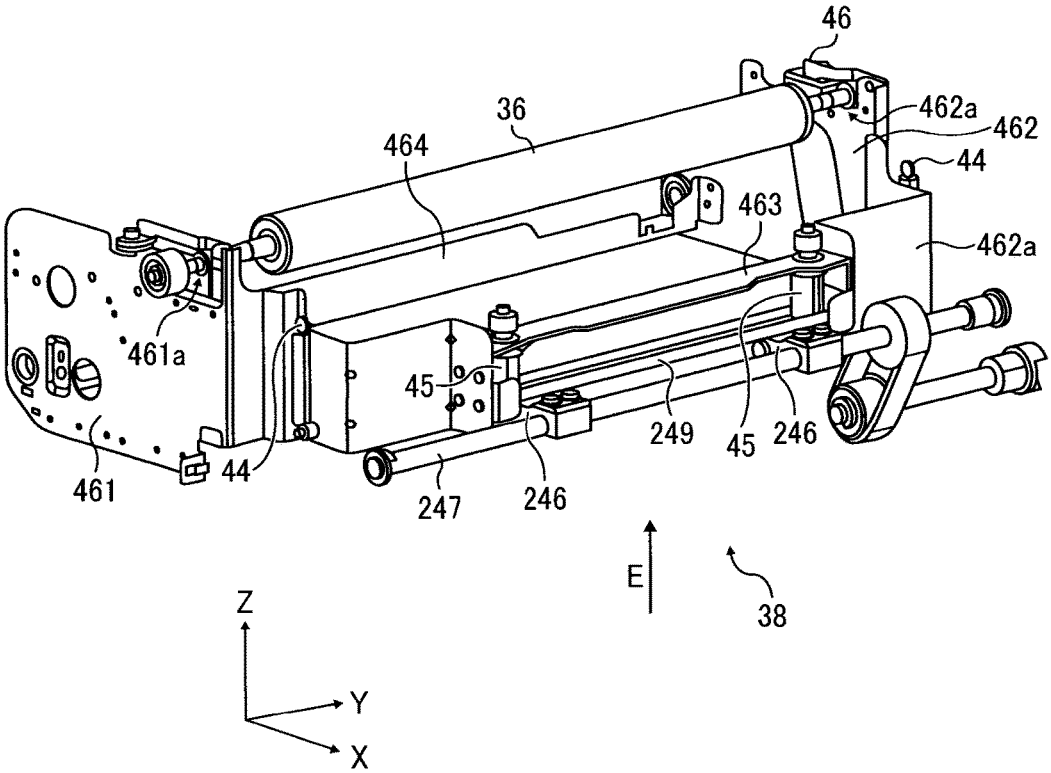
FIG. 17 is a perspective view of a sheet conveyor unit of the image forming apparatus according to an example of the present disclosure.
Figure 18:
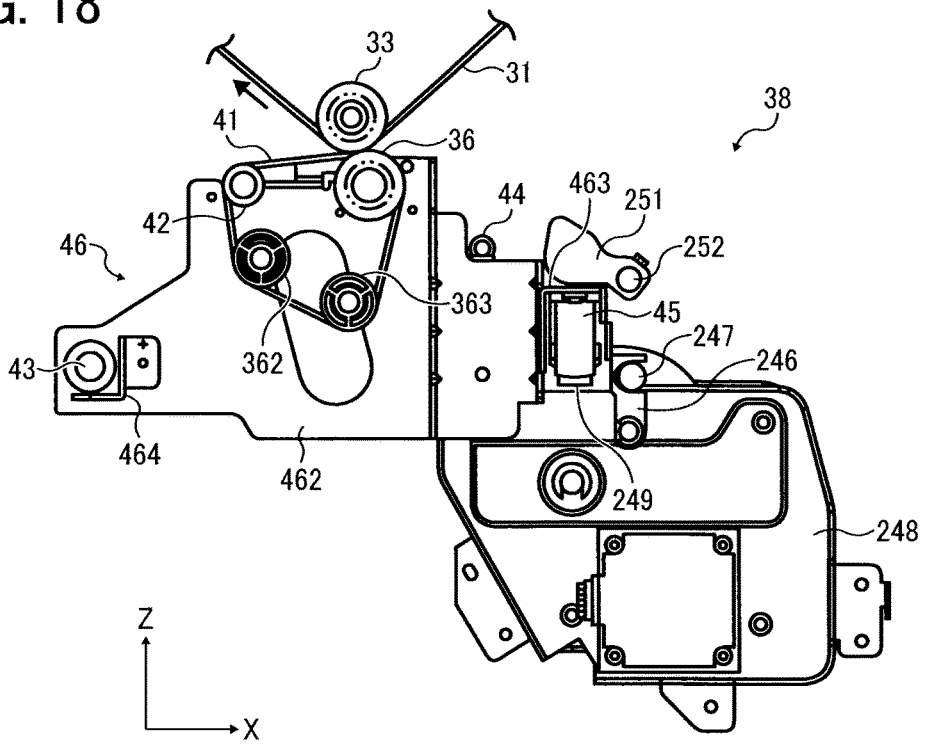
FIG. 18 is a front view of the sheet conveyor unit.
Figure 19:
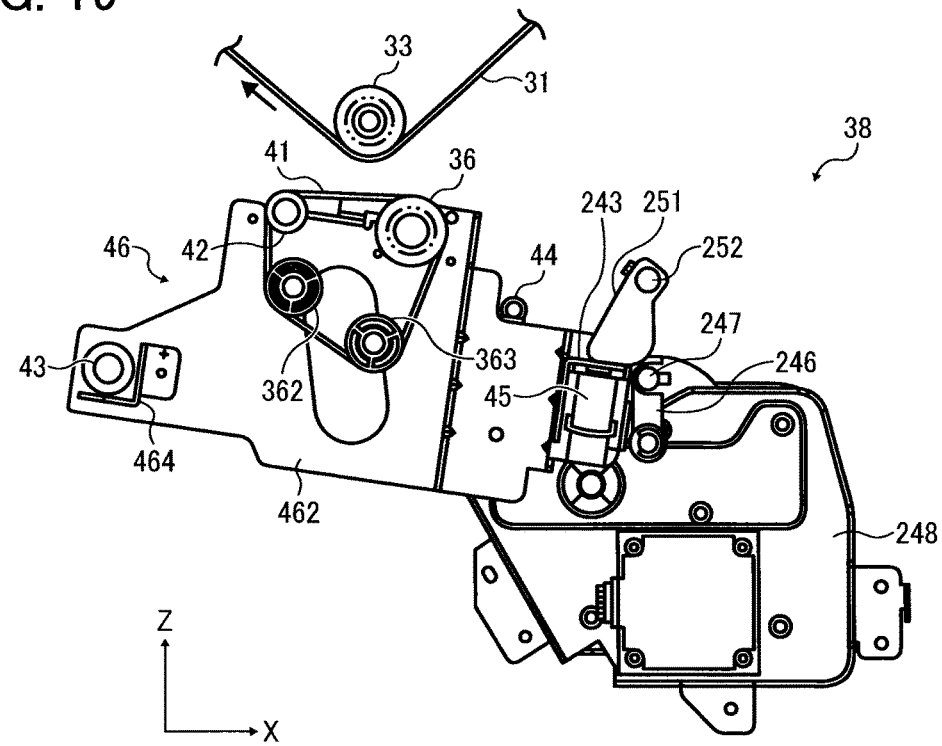
FIG. 19 is a front view of the sheet conveyor unit in a state of being spaced away from the intermediate transfer belt.
Figure 20:
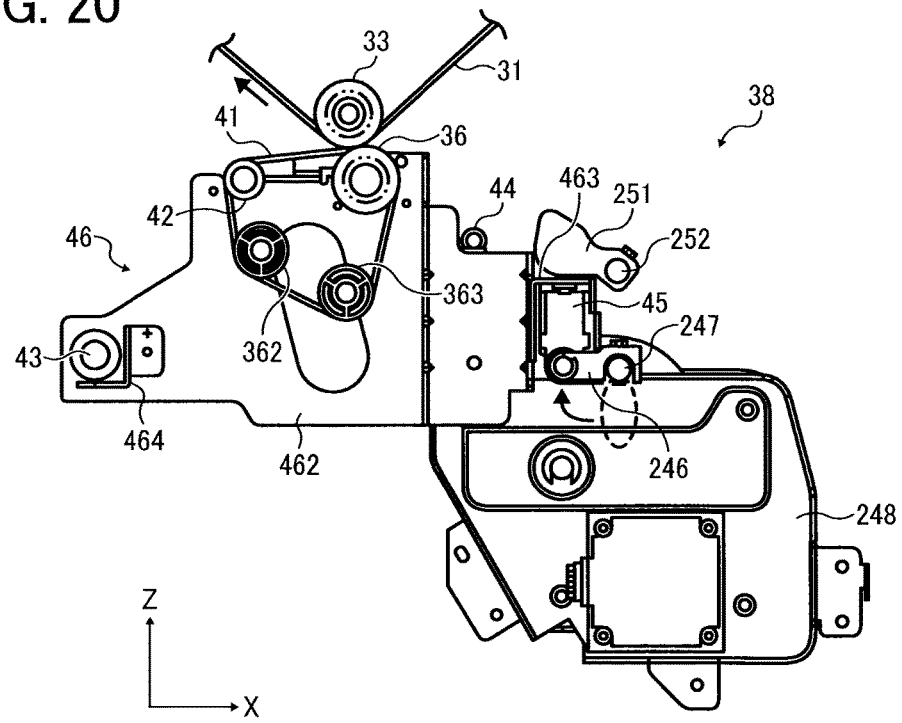
FIG. 20 is a front view of the sheet conveyor unit in which a pressure arm is in a retreated state.

FIG. 17 is a perspective view of the sheet conveyor unit 38 of an image forming apparatus according to the present example. FIG. 18 is a front view of the sheet conveyor unit 38. FIG. 19 is a front view of the sheet conveyor unit 38 in a state of being spaced away from the intermediate transfer belt 31. FIG. 20 is a front view of the sheet conveyor unit 38 in which a pressure arm 246 is in a retreated state.

In FIGS. 17 through 20, the sheet conveyor unit 38 includes a pressure board 46 that rotatably supports both lateral ends of a rotation shaft of a secondary-transfer second roller 36. The pressure board 46 is rotatable around a pressure board rotation shaft 43 parallel to the rotation shaft of the secondary-transfer second roller 36.

The pressure board 46 receives a biasing force of a tensile spring 44 and a compression spring 45 as an elastic member on a side (right side in the drawing) at which the secondary transfer second roller 36 is disposed relative to a side at which the pressure board rotation shaft 43 is disposed, and thus torque for rotation around the pressure board rotation shaft 43 is given to the pressure board 46. Due to the torque, a site of the sheet conveyor belt 41, which is wound around the secondary-transfer second roller 36, comes into contact with the intermediate transfer belt 31, and thus a secondary transfer nipping pressure is generated between the sheet conveyor belt 41 and the intermediate transfer belt 31.

The tensile spring 44, which is a pressing member, is disposed to pull the pressure board 46 from an upper side, and applies an approximately constant biasing force to the pressure board 46. On the other hand, the compression spring 45, which is a pressing member, is disposed to push the pressure board 46 upward from a lower side, and is configured in such a manner that a lower end position of the compression spring 45 is displaceable in an upper and lower direction in accordance with a rotation angle of the pressure arm 246. The pressure arm 246 rotates around a pressure arm rotation shaft 247 by a rotation drive source 248. A stationary rotation angle of the pressure arm 246 can be changed by controlling the rotation drive source 248 by the controller.

The sheet conveyor unit 38 can switch a pressing force on one end side thereof between 30 N and 120 N by using the biasing force of a set of the tensile spring 44 and the compression spring 45 which are provided on one end side in an axial direction of the secondary-transfer second roller 36. The tensile spring 44 applies a pressing force of 30 N by the biasing force thereof. A pressure stay 249 is attached to a lower end of the compression spring 45, and when the pressure arm 246 pushes the pressure stay 249 upwardly, the biasing force by the compression spring 45 acts on the pressure board 46.

When it enters a retreated state in which the pressure arm 246 stops at a rotation angle position (second rotation angle) as illustrated in FIG. 18, the pressure arm 246 is detached from the pressure stay 249 that is attached to the lower end of the compression spring 45, and a compression amount of the compression spring 45 becomes zero (natural length). In this state, the biasing force of the compression spring 45 does not act on the pressure board 46, and thus the pressing force on the one side becomes 30 N due to only the biasing force of the tensile spring 44. When the pressure arm 246 stops at the second rotation angle illustrated in FIG. 18, the pressing force on the one end side is realized by only the biasing force due to the tensile spring 44 of which a variation rate in a restoring force with respect to a unit compression amount or a unit tensile amount is smaller than that of the compression spring 45. Accordingly, there is an advantage that it is easy to obtain a target secondary transfer nipping pressure.

On the other hand, when it enters a compression spring pressurized state in which the pressure arm 246 stops at a rotation angle position (first rotation angle) illustrated in FIG. 20, the pressure stay 249 attached to the lower end of the compression spring 45 is pushed upward. According to this, the compression spring 45 is compressed, and the biasing force of the compression spring 45 acts on the pressure board 46. In this state, a pressing force of 90 N is applied to the pressure board 46 due to the biasing force of the compression spring 45, and the pressing force on the one end side becomes 120 N that is the sum of 30 N due to the biasing force of the tensile spring 44 and 90 N due to the biasing force of the compression spring 45.

The above-description has been given of the pressure arm 246 on the one end side, but a pressure arm 246 on the other end side also switches the pressing force between 30 N and 120 N. When the two pressure arms 246 switch the biasing force, respectively, the secondary transfer nipping pressure is switched between 60 N and 240 N.

Examples of the tensile spring 44 include a spring member having a spring constant of 1.3 M/mm. In addition, examples of the compression spring 45 include a spring member having a spring constant of 2.6 N/mm.

The sheet conveyor unit 38 includes a separation arm 251 as a mover that moves the sheet conveyor belt 41 from a contact position at which the sheet conveyor belt 41 is brought into contact with a front surface of the intermediate transfer belt 31 to a separation position at which the sheet conveyor belt 41 is separated from the front surface. The separation arm 251 rotates around the center of the separation arm rotation shaft 252 with operation of a separation lever. A stationary rotation angle position of the separation arm 251 can be switched through the operation of the separation lever.

The separation arm 251 is arranged in such a manner that a free end side portion thereof is located on an upper surface side of the pressure board 46. During an image formation operation, as illustrated in FIG. 18, the separation arm 251 stops at a rotation angle position at which the pressure board 46 is not pushed downward. In this state, the secondary-transfer second roller 36 is constrained to the contact position at which the secondary-transfer second roller 36 contacts the intermediate transfer belt 31.

By contrast, during a maintenance operation such as replacement of the secondary transfer unit 41 or a jam treatment, an operator operates the separation lever to move the separation arm 251 to a rotation angle position illustrated in FIG. 19. In this state, the free end side portion of the separation arm 251 contacts the upper surface of the pressure board 46, and pushes the pressure board 46 downward against the biasing force of the tensile spring 44. According to this, the pressure board 46 rotates around the pressure board rotation shaft 43, and as illustrated in FIG. 19, the secondary transfer second roller 36 moves to a separation position at which the secondary-transfer second roller 36 is separated from the intermediate transfer belt 31. Such separation facilitates operations of the maintenance treatment or the jam treatment to be carried out.

In the above-described retreated state, the pressure arm 246 is located out of a rotation range (movement route) of the pressure board 46, which rotates around the pressure board rotation shaft 43, by the separation arm 251 that moves in conjunction with the separation lever. Since the pressure arm 246 is located out of the rotation range of the pressure board 46, the secondary-transfer second roller 36 can move from the contact position to the separation position without being hindered by the pressure arm 246.

The sheet conveyor belt 41 having an endless shape is stretched by four rollers including the secondary-transfer second roller 36, a separation roller 42, a secondary transfer first stretching roller 362, and a secondary transfer second stretching roller 363. The four rollers are supported by the above-described transfer unit 30, and it is possible to detach the sheet conveyor belt 41 from the pressure board 46 in combination with the four rollers by detaching the transfer unit 30 from the pressure board 46.

The pressure board 46 supports both ends of the secondary transfer second roller 36 in an axial direction (Y direction in FIG. 17), and includes a front side plate 461 and a rear side plate 462 which determine a position of the secondary-transfer second roller 36 with respect to the pressure board 46. The two side plates 461 and 462 are connected to each other through two stays including a rotation shaft side stay 464 as a stopper that extends in the Y direction in FIG. 17, and a pressure side stay 463 as a displaceable stopper.

The pressure board 46 forms a structure body, in which a shape from an upper side (in a X-Y plane in the drawing) is an approximately rectangular shape, by the front side plate 461, the rear side plate 462, the rotation shaft side stay 464, and the pressure side stay 463. The front side plate 461 rotatably supports a front end of the secondary-transfer second roller 36 in an axial direction at a front side plate bearing portion 461*a*. In addition, the rear side plate 462 rotatably supports an inner end of the secondary-transfer second roller 36 in the axial direction at a rear side plate bearing portion 462*a*.

The rotation shaft side stay 464 is constituted by sheet metal, and portions in the vicinity of both ends in the axial direction (Y direction) are bent at a right angle and form opposing faces which are opposite to the side plates 461 and 462, respectively. The opposing faces are fixed to the side plates 461 and 462, respectively, and thus rotation shaft sides of the respective side plates restrict relative movement between the respective side plates in an axial direction (Y direction) by the rotation shaft side stay 464. In addition, the opposing faces, which are opposite to the side plates 461 and 462, of the both ends of the rotation shaft side stay 464 in the axial direction are fixed to the side plates 461 and 462, and thus the side plates 461 and 462 are reinforced. As described above, the opposing faces, which are opposite to the side plates 461 and 462, of the both ends of the rotation shaft side stay 464 in the axial direction function as a reinforcing portions which reinforce the respective side plates 461 and 462.

In the image forming apparatus 1000 according to the first embodiment, as described above, in the case of forming an image on an uneven surface sheet such as Leathac 66, a bias including only a DC voltage is used as the secondary transfer bias. According to this, as illustrated in a combination of a multi-layer belt and DC in Table 2, it is possible to realize favorable toner transferability at the recessed portions and the raised portions of the uneven surface sheet. In the combination of the multi-layer belt and DC, an evaluation result of "good" for the recessed surface portions does not represent a state in which the inside of the recessed surface portions is completely filled with toner. A portion, to which toner is not transferred, exists at a considerably deeper position on an inner side of the recessed surface portions. In comparison to an evaluation result of "good", an evaluation result of "excellent" in which toner is transferred to an inner deeper position is ideal for the recessed surface portions.

The inventors of the present application have performed a fourth experiment of investigating a relationship between secondary transfer nipping pressure and toner transferability by using a second prototype image forming apparatus. As is the case of the image forming apparatus according to the present example, a second prototype image forming apparatus can switch the secondary transfer nipping pressure between 60 N and 240 N in accordance with a variation in a rotation stoppage position of the pressure arm. The inventors of the present application have performed test printing under respective secondary transfer nipping pressure conditions. In the case of using a plain paper sheet as a recording sheet, a configuration, in which a bias including a superimposed voltage in which duty was set to be greater than 50% was used as the secondary transfer bias, was employed. In addition, in the case of using Leathac 66 which is the uneven surface sheet, a bias including only a DC voltage was employed as the secondary transfer bias. As the intermediate transfer belt 31, an intermediate transfer belt, which is constituted by a multi-layer belt having the same configuration as in the image forming apparatus 1000 according to the first embodiment, was used. Under respective conditions, a test image was printed on the recording sheet P, and toner transferability was evaluated as four grades including "excellent", "good", "fair", and "poor". In the case of using Leathac 66 as the recording sheet P, the transferability of toner to the recessed surface portions was evaluated. In addition, in the case of using the plain paper sheet, the transferability of toner to smooth surface portions of the plain paper sheet were evaluated. In addition, disturbance in a dot shape was evaluated as two grades including "absence of disturbance (good)" and "presence of disturbance (poor)". Results of the fourth experiment are listed in Table 4.

TABLE 4

| Recording Sheet | Secondary Transfer Bias | Secondary Transfer Nipping Pressure [N] | Toner Transferability at Recessed Surface Portion | Toner Transferability at Smooth Surface Portion | Disturbance in Dot Shape |
|---|---|---|---|---|---|
| Uneven Surface Sheet | DC Voltage | 60 | Good | — | Good |
| Uneven Surface Sheet | DC voltage | 240 | Excellent | — | Good |
| Plain Paper Sheet | High-duty AC/DC | 60 | — | Good | Good |
| Plain Paper Sheet | High-duty AC/DC | 240 | — | Good | Poor |

As listed in Table 4, in the case of using the uneven surface sheet as the recording sheet P, and employing a bias including only a DC voltage as the secondary transfer bias, when the secondary transfer nipping pressure was set to 60 N, the transferability of toner to the recessed surface portions was evaluated as "good". In contrast, when the secondary transfer nipping pressure was raised from 60 N to 240 N, the transferability of toner to the recessed surface portions could be improved to an evaluation result of "excellent". With regard to the dot shape, an evaluation result of "absence of disturbance (good)" was obtained even in any secondary transfer nipping pressure condition.

On the other hand, in the case of using the uneven surface sheet as the recording sheet P, and employing a bias including a high-duty superimposed voltage as the secondary transfer bias, even in any secondary transfer nipping pressure condition, favorable toner transferability could be obtained (good). However, under a condition in which the secondary transfer nipping pressure was set to 240 N, the dot shape was disturbed due to dot disturbance (presence of disturbance (poor)). In contrast, under a condition in which the secondary transfer nipping pressure was set to 60 N, disturbance in the dot shape did not occur (absence of disturbance (good)).

Figure 21:
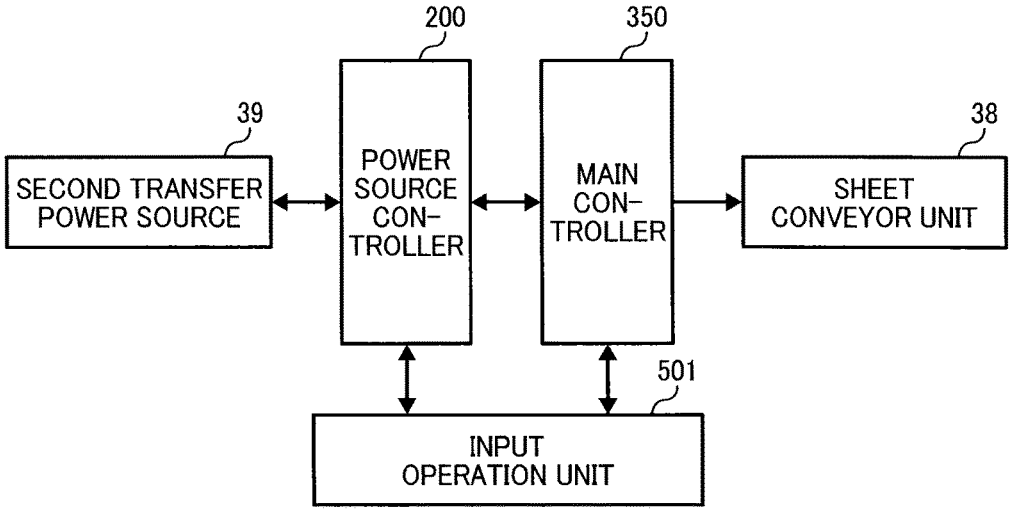
FIG. 21 is a block diagram of a portion of an electrical circuit of the image forming apparatus according to an example of the present disclosure.

FIG. 21 is a block diagram of a portion of an electrical circuit of the image forming apparatus according to the present example. As can be seen from the FIG. 21, a main controller 350, which controls drive of respective devices of the image forming apparatus, is connected to the power source controller 200 that controls an output of the secondary transfer bias from the secondary transfer power source 39. As is the case with the image forming apparatus 1000 according to the first embodiment, the main controller 350 controls the secondary transfer bias in accordance with specific information input to the input operation unit 501 as listed in Table 3. In the image forming apparatus according to the present example, a combination of the main controller 350 and the power source controller 200 functions as a controller.

On the other hand, in a case where the specific information input to the input operation unit 501 is information corresponding to the uneven surface sheet, the main controller 350 controls the sheet conveyor unit 38 as a nipping pressure adjuster to set the secondary transfer nipping pressure to 240 N. According to this, toner is transferred to a deeper position in the recessed surface portions of the uneven surface sheet in a favorable manner to obtain very good toner transferability at the recessed surface portions. In contrast, in a case where the specific information input to the input operation unit 501 is not information corresponding to the uneven surface sheet, the main controller 350 controls the sheet conveyor unit 38 to set the secondary transfer nipping pressure to 60 N. According to this, it is possible to reduce disturbance in the dot shape in the case of using the plain paper sheet and the like other than the uneven surface sheet.

Next, description will be given of an image forming apparatus according to a second embodiment of the present disclosure. Furthermore, the basic configuration of the image forming apparatus according to the second embodiment is the same as the basic configuration of the image forming apparatus 1000 according to the first embodiment.

The inventors of the present application have performed a fifth experiment of performing test printing under various conditions by using the prototype image forming apparatus. With regard to the secondary transfer bias, a bias including only a DC voltage, a bias including a superimposed voltage in which duty was set to be greater than 50%, and a bias including a superimposed voltage in which duty was set to 50% or less were appropriately switched. In addition, the intermediate transfer belt 31 was switched between a multi-layer belt configuration having the same multi-layer structure as in the image forming apparatus 1000 according to the first embodiment, and a single-layer belt configuration including only a base layer. In addition, as the recording sheet P, an uneven surface sheet (Leathac 66, manufactured by Tokushu Tokai Paper Co., Ltd.) was used. Under respective conditions, a test image was printed on the recording sheet P, and the transferability of toner to the recessed surface portions and the transferability of toner to the raised surface portions were evaluated as three grades including "good", "fair", and "poor".

Results are listed in Table 5.

TABLE 5

| | Secondary Transfer Bias | DC | High-duty AC/DC | Low-duty AC/DC | Toner Transferability |
|---|---|---|---|---|---|
| Intermediate Transfer Belt | Multi-layer belt | Good | Fair to Good | Good | Recessed Surface portion |
| | | Good | Poor | Poor | Raised Surface portion |
| | Single-layer belt | Poor | Poor | Good | Recessed Surface portion |
| | | — | — | Good | Raised Surface portion |

The results are similar to the results of the uneven surface sheet in Table 2 except for the case of using a combination of the multi-layer belt and the high-duty secondary transfer bias, and the case of using a combination of the single-layer belt and the high-duty secondary transfer bias. In any case, results of the fifth experiment were slightly worse than the results (results of the third experiment) in Table 2. The reason for results in the former case are evaluated as "fair to good" is that a slight decrease in the amount of toner was recognized at the deepest portion of the recessed surface portions. The reason for the difference from the results in Table 2 is considered to be because a bias, of which a peak-to-peak value is greater than that in the third experiment, was used in the fifth experiment as the high-duty secondary transfer bias. Therefore, in the case of using the uneven surface sheet, even when using a secondary transfer bias including a superimposed voltage without using a secondary transfer bias including only a DC voltage similar to the first embodiment, it is implied that there is a possibility that satisfactory results are obtained depending on a peak-to-peak value of the secondary transfer bias.

Here, the inventors of the present application have performed a sixth experiment of investigating toner transferability with respect to the raised surface portions of the uneven surface sheet by secondary-transferring a test image to the uneven surface sheet under respective peak-to-peak value conditions while changing a peak-to-peak value in the secondary transfer bias including a superimposed voltage. As the test image, a half-tone image was employed. Grade 5 indicates that, with regard to the toner transferability with respect to the raised surface portions of the uneven surface sheet, a sufficient half-tone density was obtained. Grade 4 indicates that a density was slightly lighter than that of Grade 4 but there was no problem. Grade 3 indicates that the density was lower than that of Grade 4, and desired image quality to satisfy users was not obtained. Grade 2 indicates that the density was lower than that of Grade 3. Grade 1 indicates that the test image looked generally white or even whiter (less density). The acceptable image quality to satisfy users was Grade 4 or above.

Results of the sixth experiment are listed in Table 6. Furthermore, Vpp in Table 6 represents a peak-to-peak value kV of an AC component of a secondary transfer bias including a superimposed voltage.

TABLE 6

| Type of Intermediate Transfer Belt | Secondary Transfer Bias | Vpp [kV] | Evaluation Grade of Transferability of Toner to Raised Portion of Sheet Surface |
|---|---|---|---|
| Multi-layer belt | Superimposed voltage | 6.4 | 1 |
| Multi-layer belt | Superimposed voltage | 4 | 1.5 |
| Multi-layer belt | Superimposed voltage | 2 | 3 |
| Multi-layer belt | Superimposed voltage | 1 | 4 |
| Multi-layer belt | DC voltage | 0 | 4.5 |

As listed in Table 6, it could be seen that as the peak-to-peak value Vpp is set to be lower, it is possible to improve the toner transferability with respect to the raised surface portions of the uneven surface sheet. This is considered to be because as the peak-to-peak value Vpp is set to be lower, time for which the secondary transfer bias is set to an average potential Vave or a value close to the average potential Vave is lengthened in one cycle of an AC component, and thus a property close to that of a DC voltage becomes strong. Accordingly, when secondary-transferring a toner image to the uneven surface sheet by using a secondary transfer bias including a superimposed voltage of which the peak-to-peak value Vpp is considerably low, it is possible to secondary-transfer toner with respect to the raised surface portions of the uneven surface sheet in a satisfactory manner. However, when using a superimposed voltage of which the peak-to-peak value Vpp is considerably low, it is difficult to transfer a toner image to a smooth sheet of paper in a favorable manner, and thus an abnormal image with dot-shaped white spots occurs.

Here, the image forming apparatus according to the second embodiment has the following characteristic configuration. The image forming apparatus according to the second embodiment includes the same secondary transfer power source 39 as in the configuration illustrated in FIG. 5. Similar to FIG. 5, the environment sensor 500 is connected to the secondary transfer power source 39.

As is the case with the image forming apparatus according to the first embodiment, as the secondary transfer bias including a superimposed voltage, the secondary transfer power source 39 outputs a secondary transfer bias configured as a bias in which time average (average potential Vave) polarity is the same as charge polarity of toner. Specifically, the secondary transfer bias is configured as a bias including an alternating voltage in which polarity is periodically inverted due to superimposition of a DC voltage and an AC voltage, but in time average (average potential Vave), the polarity becomes negative polarity that is the same as that of toner. The power source controller 200 calculates absolute humidity inside the image forming apparatus 1000 from the temperature and the relative humidity which are obtained on the basis of signals transmitted from the environment sensor 500.

An input operation unit 501 is also connected to the power source controller 200. When an input operation is performed by a user with respect to the input operation unit that is constituted by a touch panel, a keyboard, and the like, the power source controller 200 can acquire the following specific information. Specifically, the specific information includes information capable of specifying whether or not a recording sheet that is set in the sheet cassette 100 is an uneven surfaced sheet or the other sheets. That is, the input operation unit 501 functions as an information acquisition device that acquires the specific information. The power source controller 200 controls a secondary transfer current as listed in Table 7 on the basis of the specific information (for example, information such as using of Leathac 66) that is input to the input operation unit, and a calculation result of the absolute humidity.

TABLE 7

| | Type of Secondary Transfer Bias including Superimposed Voltage | | | |
|---|---|---|---|---|
| Absolute Humidity x | Plain Paper Sheet | Coated Sheet | Uneven Sheet | Other |
| $x \geq 6$ g/m$^3$ | First | First | Second | First |
| $x < 6$ g/m$^3$ | Second | Second | Second | Second |

* Vpp [kV] of first superimposed voltage > Vpp [kV] of second superimposed voltage As a specific aspect of acquiring specific information by the input operation unit 501 and determining whether or not the specific information corresponds to the uneven surface sheet by the power source controller 200, for example, it is possible to employ any one of Aspect 1, Aspect 2, and Aspect 3 which are described in the first embodiment.

In Table 7, the secondary transfer bias including a first superimposed voltage has the peak-to-peak value Vpp of an AC component which is higher than that of a secondary transfer bias including a second superimposed voltage, but the other characteristics are the same as those of the second superimposed voltage. However, characteristics other than the peak-to-peak value Vpp may be the different from each other between the first superimposed voltage and the second superimposed voltage.

As listed in Table 7, the power source controller 200 outputs a bias including a superimposed voltage from the secondary transfer power source 39 as the secondary transfer bias regardless of the type of the recording sheet P. However, control of changing the type of the superimposed voltage in accordance with the type of the recording sheet P is performed. Specifically, in a case where the absolute humidity x is 6 g/m$^3$ or higher, and a sheet other than the uneven surface sheet is used as the recording sheet P, a secondary transfer bias including the first superimposed voltage is used. On the other hand, in a case where the absolute humidity x is 6 g/m$^3$ or higher, and the uneven surface sheet is used as the recording sheet P, a secondary transfer bias including the second superimposed voltage is used. According to this, even in the uneven surface sheet that is likely to allow a secondary transfer current to concentrically flow to the recessed surface portions of on a sheet surface, a necessary amount of secondary transfer current is also allowed to flow to the raised surface portions, and thus it is possible to reduce occurrence of insufficient image density at the raised surface portions. On the other hand, in a case where a recording sheet P other than the uneven surface sheet is used, a secondary transfer bias as the secondary transfer bias, a bias including the first superimposed voltage, in which the peak-to-peak value Vpp of an AC component is higher than that of the second superimposed voltage, is used. According to this, it is possible to reduce occurrence of insufficient image density over the entirety of the smooth surface portions due to implantation of an opposite polarity charge to toner at the secondary transfer nip.

In addition, in a case where the absolute humidity x is lower than 6 g/m$^3$, the power source controller 200 uses a secondary transfer bias including the second superimposed voltage regardless of whether or not the recording sheet P is the uneven surface sheet. According to this, In the case of using a plain paper sheet, a coated sheet, and other sheets of paper in which surface unevenness does not exist, a potential difference between a belt surface and a sheet surface is retained to be less than a discharge initiation voltage to reduce occurrence of the abnormal image with a lot of dot-shaped white spots.

Furthermore, description has been given of an aspect of selecting whether or not to use a bias including only the first superimposed voltage or a bias including the second superimposed voltage as the secondary transfer bias on the basis of the absolute humidity in the case of using the recording sheet P other than the uneven surface sheet, but the following aspect may be employed. Specifically, selection of any secondary transfer bias may be performed on the basis of only the temperature, only the relative humidity, or both of the temperature and the relative humidity.

In addition, description has been given of an example in which the input operation unit 501 is used as the information acquisition device that acquires specific information, but a measurement device measuring the degree of surface unevenness of the recording sheet P may be provided, and a detection result obtained by the measurement device may be used as the specific information. Examples of the measurement device that measures the degree of surface unevenness of the recording sheet P include a measurement device that measures the maximum unevenness difference on the surface of the recording sheet P. With regard to a method of measuring the maximum unevenness difference, the method described in the first embodiment may be used.

For example, in a case where the maximum unevenness difference of the recording sheet P which is measured by a measurement device is less than 50 μm, the power source controller 200 of the image forming apparatus outputs a bias including the first superimposed voltage from the secondary transfer power source 39 as the secondary transfer bias. In contrast, for example, in a case where the maximum unevenness difference is 50 μm or greater, the power source controller 200 outputs a bias including the second superimposed voltage from the secondary transfer power source 39 as the secondary transfer bias.

As other measurement devices which measure the degree of surface unevenness of the recording sheet P, as described in the first embodiment, the method of measuring the smoothness of the recording sheet P may be employed. In the case of employing the method, in a case where the smoothness of the recording sheet P is, for example, 20 seconds or higher, the power source controller 200 of the image forming apparatus outputs a bias including the first superimposed voltage from the secondary transfer power source 39 as the secondary transfer bias. In contrast, in a case where the smoothness is, for example, lower than 20 seconds, the power source controller 200 outputs a bias including the second superimposed voltage from the secondary transfer power source 39 as the secondary transfer bias. That is, in a case where the surface unevenness of the recording sheet P, which is measured with the maximum unevenness difference or the smoothness, is less than a predetermined value, the power source controller 200 outputs a bias including the first superimposed voltage from the secondary transfer power source 39 as the transfer bias. On the other hand, when the surface unevenness is equal to or greater than the predetermined value, the power source controller 200 outputs a bias including the second superimposed voltage from the secondary transfer power source 39 as the transfer bias.

Examples of the first superimposed voltage include a superimposed voltage in which the peak-to-peak value is 6.4 kV, and a DC voltage is controlled with a constant current to approximately −120 μA. In addition, examples of the second superimposed voltage include a superimposed voltage in which the peak-to-peak value is 0.5 kV, and a DC voltage is controlled with a constant current to approximately −120 μA.

The image forming apparatus according to the second embodiment includes the sheet conveyor unit 38 (refer to FIG. 17 to FIG. 20) having the same configuration as in the image forming apparatus according to the above-described example. In addition, the image forming apparatus also includes an electrical circuit (refer to FIG. 21) having the same configuration as in the image forming apparatus according to the above-described example. In addition, in a case where specific information input to the input operation unit 501 is information corresponding to the uneven surface sheet, the main controller 350 controls the sheet conveyor unit 38 as the nipping pressure adjuster to set the secondary transfer nipping pressure to 240 N. According to this, toner is transferred to a deeper position in the recessed surface portions of the uneven surface sheet in a favorable manner to obtain very good toner transferability at the recessed surface portions. In contrast, in a case where the specific information input to the input operation unit 501 is not information corresponding to the uneven surface sheet, the main controller 350 controls the sheet conveyor unit 38 to set the secondary transfer nipping pressure to 60 N. According to this, it is possible to reduce disturbance in the dot shape in the case of using the plain paper sheet and the like other than the uneven surface sheet.

Although the embodiments of the present disclosure have been described above, the present disclosure is not limited to the foregoing embodiments, but a variety of modifications can naturally be made within the scope of the present disclosure. For example, the present disclosure also includes aspects having the following advantages.

Aspect A

An image forming apparatus includes a toner image forming unit (including, for example, the toner image forming units (1Y, 1M, 1C, and 1K), the optical recording unit (80), and the transfer unit (30)) to form a toner image on a moving surface of an image bearer (for example, the intermediate transfer belt (31)); a nip formation member (for example, the sheet conveyor belt 41) to contact the surface of the image bearer to form a transfer nip; a transfer power source (for example, the secondary transfer power source 39) to output a bias including a superimposed voltage, in which an AC voltage is superimposed on a DC voltage, as a transfer bias to flow a transfer current to the transfer nip to transfer the toner image from the image bearer onto a recording sheet in the transfer nip; an information acquisition device (for example, the input operation unit (501) that acquires specific information (for example, the input information) to specify whether the recording sheet as a transfer target of the toner image is an uneven surface sheet in which surface unevenness is great; and a controller (for example, the power source controller 200) to output a bias including a superimposed voltage as the transfer bias from the transfer power source when the specific information acquired by the information acquisition device is not information corresponding to the uneven surface sheet and to output a bias including only a DC voltage as the transfer bias from the transfer power source when the specific information is the information corresponding to the uneven surface sheet.

In the above-described configuration, a value of the transfer bias including the superimposed voltage is periodically changed between one peak value and the other peak value in a peak-to-peak. In the two peak values, a transfer peak value, which more strongly applies an electrostatic force to toner in the transfer nip in a transfer direction facing a recording sheet side from an image bearer side, participates to occurrence of insufficient image density at raised portions of the uneven surface sheet, or occurrence of abnormal image with dot-shaped white spots. Specifically, in the uneven surface sheet, a volume specific resistance value of a site (recessed portion site) of a recessed portion on a surface in a sheet surface direction is smaller than a volume specific resistance value of a site (raised portion site) of a raised portion on the surface. Therefore, in the uneven surface sheet that is nipped in the transfer nip, a transfer current preferentially flows to the recessed portion site in relation to the raised portion site. Accordingly, in a case where the transfer peak value of the transfer bias including the superimposed voltage is a relatively low value, the majority of the transfer current flows into the recessed portion site, and thus the amount of the transfer current that flows to the raised portion site becomes insufficient. According to this, a sufficient amount of toner is not transferred to the raised portion site, and thus insufficient image density occurs at the raised portion site. In the case of increasing the transfer peak value to a value capable of allowing a sufficient amount of transfer current to flow to the raised portion site so as to reduce occurrence of the insufficient image density, the value is made to be greater than a discharge initiation voltage between the image bearer and the sheet surface, and thus discharge is likely to occur between the image bearer and the sheet surface. In addition, an abnormal image with dot-shaped white spots occurs due to the discharge.

On the other hand, as the transfer bias, in the case of using the bias including only the DC voltage instead of the bias including the superimposed voltage, an electrostatic force is continuously applied to toner in the transfer nip in a transfer direction differently from the case of using the bias including the superimposed voltage. Accordingly, it is possible to allow a sufficient amount of transfer current to flow to the raised portion site at a DC voltage in a value lower than the transfer peak value capable of allowing a sufficient amount of transfer current to flow to the raised portion site in the case of using the transfer bias including the superimposed voltage. According to this, it is possible to reduce occurrence of insufficient image density at the raised portions, and occurrence of an abnormal image with dot-shaped white spots.

However, when using the transfer bias including only the DC voltage, in the case of using a flat sheet as the recording sheet, a large amount of opposite charges are implanted to toner in the transfer nip, and thus insufficient image density at the entirety of the sheet surface is likely to occur.

In Aspect A, in the case of using the flat sheet, the toner image is transferred to the flat sheet from the image bearer by using the transfer bias including the superimposed voltage. According to this, implantation of the opposite charges to toner in the transfer nip is further reduced in comparison to the case of using the transfer bias including only the DC voltage that continuously applies an electrostatic force in the transfer direction, and thus it is possible to reduce occurrence of insufficient image density at the entirety of the sheet surface. In addition, in the case of using the uneven surface sheet, toner on the image bearer is transferred to the uneven surface sheet by using the transfer bias including only the DC voltage. Such a configuration reduces occurrence of insufficient image density at the raised portions of the uneven surface sheet or occurrence of an abnormal image with dot-shaped white spots at the entirety of the surface of the uneven surface sheet.

As described above, according to Aspect A, it is possible to reduce occurrence of insufficient image density at the recessed surface portions of the uneven surface sheet, or occurrence of an abnormal image with dot-shaped white spots at the entirety of the surface of the uneven surface sheet. In addition, it is possible to reduce occurrence of insufficient image density at the entirety of the surface of the flat sheet.

Aspect B

In the image forming apparatus according to Aspect A, the image bearer includes an endless belt base and an elastic layer on a front surface of the belt base. The elastic layer has an elasticity greater than an elasticity of the belt base. In the above-described configuration, even when using the uneven surface sheet as the recording sheet, the elastic layer of the image bearer is flexibly deformed at the transfer nip in conformity to the sheet surface unevenness, thus allowing the elastic layer to favorably fit the recessed surface portions of the uneven surface. With such a configuration, toner on the image bearer is transferred to the recessed surface portions in a favorable manner, thus reducing the occurrence of uneven image density depending on the surface unevenness.

Aspect C

The image forming apparatus according to Aspect B includes an elastic surface layer as the elastic layer. The elastic surface layer has a surface including a plurality of fine projections made of a plurality of fine particles dispersed in a material of the elastic surface layer. In the above-described configuration, a contact area between a surface of the elastic surface layer and toner in the transfer nip is reduced due to the plurality of fine projections on the surface of the elastic surface layer. Accordingly, toner releasability from a surface of the image bearer is enhanced, thus improving transfer efficiency.

Aspect D

The image forming apparatus according to any one of Aspect A to Aspect C further includes an environment detector to detect at least one of temperature and humidity. The controller outputs the bias including the superimposed voltage as the transfer bias from the transfer power source when a temperature detection result obtained by the environment detector, a relative humidity detection result obtained by the environment detector, or an absolute humidity based on the temperature detection result and the relative humidity detection result is equal to or higher than a predetermined threshold value, or higher than the threshold value, and when the specific information acquired by the information acquisition device is not the information corresponding to the uneven surface sheet. In the case of using a flat sheet under a high-temperature or high-humidity environment, the above-described configuration prevents occurrence of insufficient image density at the entirety of the sheet surface due to usage of the transfer bias including only the DC voltage.

Aspect E

In the image forming apparatus according to Aspect D, the controller outputs the bias including only the DC voltage as the transfer bias from the transfer power source when the specific information acquired by the information acquisition device is not the information corresponding to the uneven surface sheet and when the temperature detection result, the relative humidity detection result, or the absolute humidity is not equal to or higher than the threshold value, or is not higher the threshold value. In the case of using the flat sheet under the low-temperature or low-humidity environment, In the above-described configuration, prevents occurrence of an abnormal image with dot-shaped white spots at the entirety of the sheet surface due to usage of the transfer bias including the superimposed voltage.

Aspect F

In the image forming apparatus according to Aspect D or Aspect E, the controller outputs the bias including only the DC voltage as the transfer bias from the transfer power source regardless of the temperature detection result, the relative humidity detection result, or the absolute humidity when the specific information acquired by the information acquisition device is the information corresponding to the uneven surface sheet. The above-described configuration reduces occurrence of insufficient image density at the raised portions of the uneven surface sheet or occurrence of an abnormal image with dot-shaped white spots at the entirety of the sheet surface regardless of an environment.

Aspect G

The image forming apparatus according to any one of Aspect A to Aspect F, further includes a nipping pressure adjuster (for example, the sheet conveyor unit 38) to change a pressure of the transfer nip. The controller controls the nipping pressure adjuster to raise the pressure to be higher when the specific information acquired by the information acquisition device is the information corresponding to the uneven surface sheet than when the specific information is not the information corresponding to the uneven surface sheet. In the above-described configuration, toner is transferred to a deeper position at the recessed surface portions of the uneven surface sheet in a favorable manner, thus obtaining more favorable toner transferability at the recessed surface portions. In addition, in the case of using a sheet other than the uneven surface sheet as the recording sheet, it is possible to reduce occurrence of disturbance of a dot shape due to an excessive high nipping pressure.

Aspect H

An image forming apparatus including: a toner image forming unit (including, for example, the toner image formation units 1Y, 1M, 1C, and 1K, the optical recording unit 80, and the transfer unit 30) to form a toner image on a moving surface of an image bearer (for example, the intermediate transfer belt (31); a nip formation member (for example, the sheet conveyor belt 41) to contact the surface of the image bearer to form a transfer nip; a transfer power source (for example, the secondary transfer power source 39) to output a bias including a superimposed voltage, in which an AC voltage is superimposed on a DC voltage, as a transfer bias to flow a transfer current to the transfer nip to transfer the toner image from the image bearer onto a recording sheet in the transfer nip; an information acquisition device (for example, the input operation unit 501) to acquire specific information (for example, input information) to specify whether the recording sheet as a transfer target of the toner image is an uneven surface sheet in which surface unevenness is great; and a controller (for example, the power source controller 200) to output a bias including a first superimposed voltage as the transfer bias from the transfer power source when the specific information acquired by the information acquisition device is not information corresponding to the uneven surface sheet and to output a bias including a second superimposed voltage, which has a peak-to-peak value smaller than a peak-to-peak value of the first superimposed voltage, as the transfer bias from the transfer power source when the specific information is the information corresponding to the uneven surface sheet.

In the above-described configuration, a value of the transfer bias including the first superimposed voltage is periodically changed between one peak value and the other peak value in a peak-to-peak. In the two peak values, a transfer peak value, which more strongly applies an electrostatic force to toner in the transfer nip in a transfer direction facing a recording sheet side from an image bearer side, participates to occurrence of insufficient image density at raised portions of the uneven surface sheet, or occurrence of abnormal image with dot-shaped white spots. Specifically, in the uneven surface sheet, a volume specific resistance value of a site (recessed portion site) of a recessed portion on a surface in a sheet surface direction is smaller than a volume specific resistance value of a site (raised portion site) of a raised portion on the surface. Therefore, in the uneven surface sheet that is nipped in the transfer nip, a transfer current preferentially flows to the recessed portion site in relation to the raised portion site. Accordingly, in a case where the transfer peak value of the transfer bias including the first superimposed voltage is a relatively low value, the majority of the transfer current flows into the recessed portion site, and thus the amount of the transfer current that flows to the raised portion site becomes insufficient. According to this, a sufficient amount of toner is not transferred to the raised portion site, and thus insufficient image density occurs at the raised portion site. In the case of increasing the transfer peak value to a value capable of allowing a sufficient amount of transfer current to flow to the raised portion site so as to suppress occurrence of the insufficient image density, the value is made to be greater than a discharge initiation voltage between the image bearer and the sheet surface, and thus discharge is likely to occur between the image bearer and the sheet surface. In addition, an abnormal image with dot-shaped white spots occurs due to the discharge.

On the other hand, as the transfer bias, in the case of using the bias including the second superimposed voltage, of which the peak-to-peak value (specifically, a peak-to-peak value of an AC component) is lower than that of the first superimposed voltage, instead of the bias including the first superimposed voltage, the following phenomenon occurs.

Specifically, it is possible to allow a sufficient amount of transfer current to flow to the raised portion site at a transfer peak value lower than the transfer peak value capable of allowing a sufficient amount of transfer current to flow to the raised portion site in the case of using the transfer bias including the first superimposed voltage. Such a configuration reduces occurrence of insufficient image density at the raised portions and occurrence of an abnormal image with dot-shaped white spots.

However, when using the transfer bias including the second superimposed voltage, in the case of using a flat sheet as the recording sheet, a large amount of opposite charges are implanted to toner in the transfer nip, and thus insufficient image density at the entirety of the sheet surface is likely to occur.

Here, in Aspect H, in the case of using the flat sheet, the toner image is transferred to the flat sheet from the image bearer by using the transfer bias including the first superimposed voltage. According to this, implantation of the opposite charges to toner in the transfer nip is further suppressed in a comparison to the case of using the transfer bias composed the second superimposed voltage, and thus it is possible to reduce occurrence of insufficient image density at the entirety of the sheet surface. In the case of using the uneven surface sheet, toner on the image bearer is transferred to the uneven surface sheet by using the transfer bias including the second superimposed voltage. According to this, it is possible to reduce occurrence of insufficient image density at the raised portions of the uneven surface sheet or occurrence of an abnormal image with dot-shaped white spots at the entirety of the surface of the uneven surface sheet.

As described above, according to Aspect H, it is possible to reduce occurrence of insufficient image density at the recessed surface portions of the uneven surface sheet, or occurrence of an abnormal image with dot-shaped white spots at the entirety of the surface of the uneven surface sheet. In addition, it is possible to reduce occurrence of insufficient image density at the entirety of the surface of the flat sheet.

Aspect I

In the image forming apparatus according to Aspect H, the image bearer includes an endless belt base and an elastic layer on a front surface of the belt base. The elastic layer has an elasticity greater than an elasticity of the belt base. In the above-described configuration, even when using the uneven surface sheet as the recording sheet, the elastic layer of the image bearer is flexibly deformed at the transfer nip in conformity to the sheet surface unevenness, thus allowing the elastic layer to favorably fit the recessed surface portions of the uneven surface. With such a configuration, toner on the image bearer is transferred to the recessed surface portions also in a favorable manner, thus reducing occurrence of uneven image density depending on the surface unevenness.

Aspect J

The image forming apparatus according to Aspect I includes an elastic surface layer as the elastic layer. The elastic surface layer has a surface including a plurality of fine projections made of a plurality of fine particles dispersed in a material of the elastic surface layer. In the above-described configuration, a contact area between a surface of the elastic surface layer and toner in the transfer nip is reduced due to the plurality of fine projections on the surface of the elastic surface layer. Accordingly, toner releasability from a surface of the image bearer is enhanced, thus improving transfer efficiency.

Aspect K

The image forming apparatus according to any one of Aspect H to Aspect J, further includes an environment detector to detect at least one of temperature and humidity. The controller outputs the bias including the first superimposed voltage as the transfer bias from the transfer power source when a temperature detection result obtained by the environment detector, a relative humidity detection result obtained by the environment detector, or an absolute humidity based on the temperature detection result and the relative humidity detection result is equal to or higher than a predetermined threshold value, or is higher than the threshold value, and when the specific information acquired by the information acquisition device is not the information corresponding to the uneven surface sheet. In the case of using a flat sheet under a high-temperature or high-humidity environment, the above-described configuration prevents occurrence of insufficient image density at the entirety of the sheet surface due to usage of the transfer bias including only the DC voltage.

Aspect L

The image forming apparatus according to Aspect K, the controller outputs the bias including the second superimposed voltage as the transfer bias from the transfer power source when the specific information acquired by the information acquisition device is not the information corresponding to the uneven surface sheet and when the temperature detection result, the relative humidity detection result, or the absolute humidity is not equal to or higher than the threshold value, or is not higher than the threshold value. In the case of using the flat sheet under the low-temperature or low-humidity environment, the above-described configuration prevents occurrence of an abnormal image with dot-shaped white spots at the entirety of the sheet surface due to usage of the transfer bias including the superimposed voltage.

Aspect M

In the image forming apparatus according to Aspect K or Aspect L, the controller outputs the bias including the second superimposed voltage as the transfer bias from the transfer power source regardless of the temperature detection result, the relative humidity detection result, or the absolute humidity when the specific information acquired by the information acquisition device is the information corresponding to the uneven surface sheet. The above-described configuration reduces occurrence of insufficient image density at the raised portions of the uneven surface sheet or occurrence of an abnormal image with dot-shaped white spots at the entirety of the sheet surface regardless of an environment.

Aspect N

The image forming apparatus according to any one of Aspect H to Aspect M, further includes a nipping pressure adjuster (for example, the sheet conveyor unit 38) to change a pressure of the transfer nip. The controller controls the nipping pressure adjuster to raise the pressure to be higher when the specific information acquired by the information acquisition device is the information corresponding to the uneven surface sheet than when the specific information is not the information corresponding to the uneven surface sheet. In the above-described configuration, toner is transferred to a deeper position at the recessed surface portions of the uneven surface sheet in a favorable manner, and thus it is possible to obtain more favorable toner transferability at the recessed surface portions. In addition, in the case of using a sheet other than the uneven surface sheet as the recording sheet, it is possible to reduce occurrence of disturbance of a dot shape due to an excessive high nipping pressure Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a toner image forming unit configured to form a toner image on a surface of an image bearer;

a nip formation member configured to contact the surface of the image bearer to form a transfer nip;

a transfer power source configured to output a transfer bias to transfer the toner image from the image bearer onto a recording sheet in the transfer nip;

an information acquisition device configured to acquire specific information that specifies whether the recording sheet as a transfer target of the toner image is an uneven surface sheet having an uneven surface; and a controller configured to output a bias including a superimposed voltage, in which an alternating current (AC) voltage is superimposed on a direct current (DC) voltage, as the transfer bias from the transfer power source when the specific information acquired by the information acquisition device is not information corresponding to the uneven surface sheet and to output a bias including only the DC voltage as the transfer bias from the transfer power source when the specific information is the information corresponding to the uneven surface sheet.

2. The image forming apparatus according to claim 1, wherein the image bearer includes an endless belt base and an elastic layer on a front surface of the belt base, and wherein the elastic layer has an elasticity greater than the belt base.

3. The image forming apparatus according to claim 2, wherein the elastic layer is an elastic surface layer having a surface including a plurality of fine projections made of a plurality of fine particles dispersed in a material of the elastic surface layer.

4. The image forming apparatus according to claim 1, further comprising an environment detector to detect at least one of temperature and humidity, wherein the controller is configured to output the bias including the superimposed voltage as the transfer bias from the transfer power source when a temperature detection result obtained by the environment detector, a relative humidity detection result obtained by the environment detector, or an absolute humidity based on the temperature detection result and the relative humidity detection result is equal to or higher than a predetermined threshold value, or is higher than the threshold value, and when the specific information acquired by the information acquisition device is not the information corresponding to the uneven surface sheet.

5. The image forming apparatus according to claim 4, wherein the controller is configured to output the bias including only the DC voltage as the transfer bias from the transfer power source when the specific information acquired by the information acquisition device is not the information corresponding to the uneven surface sheet and when the temperature detection result, the relative humidity detection result, or the absolute humidity is not equal to or higher than the threshold value, or is not higher than the threshold value.

6. The image forming apparatus according to claim 4, wherein the controller is configured to output the bias including only the DC voltage as the transfer bias from the transfer power source regardless of the temperature detection result, the relative humidity detection result, or the absolute humidity when the specific information acquired by the information acquisition device is the information corresponding to the uneven surface sheet.

7. The image forming apparatus according to claim 1, further comprising a nipping pressure adjuster configured to change a pressure of the transfer nip, wherein the controller is configured to control the nipping pressure adjuster to raise the pressure to be higher when the specific information acquired by the information acquisition device is the information corresponding to the uneven surface sheet than when the specific information is not the information corresponding to the uneven surface sheet.

8. An image forming apparatus, comprising:

a toner image forming unit configured to form a toner image on a surface of an image bearer;

a nip formation member configured to contact the surface of the image bearer to form a transfer nip;

a transfer power source configured to output a bias including a superimposed voltage, in which an alternating current (AC) voltage is superimposed on a direct current (DC) voltage, as a transfer bias to transfer the toner image from the image bearer onto a recording sheet in the transfer nip:

an information acquisition device configured to acquire specific information that specifies whether the recording sheet as a transfer target of the toner image is an uneven surface sheet having an uneven surface; and a controller configured to output a bias including a first superimposed voltage as the transfer bias from the transfer power source when the specific information acquired by the information acquisition device is not information corresponding to the uneven surface sheet and to output a bias including a second superimposed voltage, which has a peak-to-peak value smaller than a peak-to-peak value of the first superimposed voltage, as the transfer bias from the transfer power source when the specific information is the information corresponding to the uneven surface sheet.

9. The image forming apparatus according to claim 8, wherein the image bearer includes an endless belt base and an elastic layer on a front surface of the belt base, and wherein the elastic layer has an elasticity greater than the belt base.

10. The image forming apparatus according to claim 9, wherein the elastic layer is an elastic surface layer having a surface including a plurality of fine projections made of a plurality of fine particles dispersed in a material of the elastic surface layer.

11. The image forming apparatus according to claim 8, an environment detector configured to detect at least one of temperature and humidity, wherein the controller is configured to output the bias including the first superimposed voltage as the transfer bias from the transfer power source when a temperature detection result obtained by the environment detector, a relative humidity detection result obtained by the environment detector, or an absolute humidity based on the temperature detection result and the relative humidity detection result is equal to or higher than a predetermined threshold value, or is higher than the threshold value, and when the specific information acquired by the information acquisition device is not the information corresponding to the uneven surface sheet.

12. The image forming apparatus according to claim 11, wherein the controller is configured to output the bias including the second superimposed voltage as the transfer bias from the transfer power source when the specific information acquired by the information acquisition device is not the information corresponding to the uneven surface sheet and when the temperature detection result, the relative humidity detection result, or the absolute humidity is not equal to or higher than the threshold value, or is not higher than the threshold value.

13. The image forming apparatus according to claim 11, wherein the controller is configured to output the bias including the second superimposed voltage as the transfer bias from the transfer power source regardless of the temperature detection result, the relative humidity detection result, or the absolute humidity when the specific information acquired by the information acquisition device is the information corresponding to the uneven surface sheet.

14. The image forming apparatus according to claim 8, further comprising a nipping pressure adjuster configured to change a pressure of the transfer nip, wherein the controller is configured to control the nipping pressure adjuster to raise the pressure to be higher when the specific information acquired by the information acquisition device is the information corresponding to the uneven surface sheet than when the specific information is not the information corresponding to the uneven surface sheet.

15. An image forming apparatus, comprising:

an image bearer to bear a toner image;

a nip formation member to form a transfer nip between the image bearer and the nip formation member;

a transfer power source; and a controller to control the transfer power source to output a bias including only a direct current (DC) component to transfer the toner image from the image bearer onto an uneven surface sheet having an uneven surface in the transfer nip and to output a bias including an alternating current (AC) component to transfer the toner image from the image bearer onto a sheet other than the uneven surface sheet in the transfer nip.

16. The image forming apparatus according to claim 15, wherein the image bearer includes an endless belt base and an elastic layer on a front surface of the belt base, and wherein the elastic layer has an elasticity greater than the belt base.

17. The image forming apparatus according to claim 16, wherein the elastic layer is an elastic surface layer having a surface including a plurality of fine projections made of a plurality of fine particles dispersed in a material of the elastic surface layer.

18. The image forming apparatus according to claim 15, wherein a duty ratio of the bias including the alternating current (AC) component is greater than 50%, the duty ratio is obtained by a following equation: $(T-A)/T\times100\%$, where T is one cycle of the bias including the alternating current (AC) component, and A is a time period, during which a electrostatic migration of toner from the image bearer to the recording medium is inhibited, in one cycle of the bias including the alternating current (AC) component.

* * * * *